US011542727B2

(12) United States Patent
Hsu

(10) Patent No.: US 11,542,727 B2
(45) Date of Patent: Jan. 3, 2023

(54) ELECTRIC CONTROL DEVICE FOR A LATCH

(71) Applicant: I-TEK METAL MFG. CO., LTD, Tainan (TW)

(72) Inventor: Wei-Chung Hsu, Tainan (TW)

(73) Assignee: I-TEK METAL MFG. CO., LTD., Tainan (TW)

( * ) Notice: Subject to any disclaimer, the term of this patent is extended or adjusted under 35 U.S.C. 154(b) by 130 days.

(21) Appl. No.: 17/148,791

(22) Filed: Jan. 14, 2021

(65) Prior Publication Data

US 2022/0195755 A1 Jun. 23, 2022

(51) Int. Cl.
*E05B 47/02* (2006.01)
*E05B 47/00* (2006.01)

(52) U.S. Cl.
CPC ..... *E05B 47/023* (2013.01); *E05B 47/0001* (2013.01); *E05B 2047/0023* (2013.01); *E05B 2047/0035* (2013.01)

(58) Field of Classification Search
CPC ..... E05B 47/023; E05B 47/0001; E05B 2047/0023; E05B 2047/0035
See application file for complete search history.

(56) References Cited

U.S. PATENT DOCUMENTS 7,770,949 B2 * 8/2010 Kunda ..... E05B 47/0046 292/341.15
8,146,966 B1 * 4/2012 Webb ..... E05B 47/0047 292/341.15
8,807,606 B2 * 8/2014 Ross ..... E05B 47/0047 292/341.15
8,833,814 B2 * 9/2014 Chang ..... E05B 47/0047 292/341.15
9,945,153 B2 * 4/2018 Scheffler ..... E05B 47/0047
10,072,441 B2 * 9/2018 Singh ..... E05B 63/0056
2010/0038920 A1 * 2/2010 Tsai ..... E05B 47/0047 292/341.16
2010/0116006 A1 * 5/2010 Huang ..... E05B 47/0047 70/91
2010/0127518 A1 * 5/2010 Huang ..... E05B 47/0047 292/341.16
2011/0031768 A1 * 2/2011 Scheffler ..... E05B 47/0046 292/341.16
2013/0088023 A1 * 4/2013 Singh ..... E05B 47/0047 292/341.16

* cited by examiner

*Primary Examiner* — Mark A Williams
(74) *Attorney, Agent, or Firm* — Alan D. Kamrath; Karin L. Williams; Mayer & Williams PC

(57) ABSTRACT

An electric control device for a latch includes a mounting seat having including a first compartment and a second compartment. An electric locking device includes a bracket securely mounted in the second compartment and a driving member securely mounted to the bracket. The driving member for actuating the locking member is coupled with a locking member. The locking member includes a stop portion having a protrusive end abutting a first face of the bracket without interfering with movement of the locking member. A locking cap device is pivotably connected to the mounting seat and is received in the first compartment. The locking cap device includes an inner side having a first protrusion corresponding to the stop portion. When the stop portion is located on a rotational path of the first protrusion, the locking cap device is not pivotable from a closure position to a non-closure position.

7 Claims, 23 Drawing Sheets

ELECTRIC CONTROL DEVICE FOR A LATCH

BACKGROUND OF THE INVENTION

The present invention relates to an electric control device for a latch and, more particularly, to a modularized latch control device that can be assembled into one of a plurality of different modes for cooperating with different types of latch devices that can be locked or unlocked by the electric control device.

An electric control device for a latch mounted on a door frame can be assembled into three types according to the latch device to be applied, thereby matching with a known cylindrical latch device or a known box type latch device. The electric control device includes a locking cap device which cannot be opened when in a locking position, preventing disengagement of the cylindrical latch device or the box type latch device to thereby avoid opening of the door. When the locking cap device is unlocked, the door can be pushed open by pushing the locking cap device without retracting the latch of the cylindrical latch device or the box type latch device. The electric control device generally relies on movement of a locking member to determine locking or unlocking of the locking cap device. The locking cap device cannot be pushed open when stopped by or engaged with the locking cap device. However, when the door is forcibly pushed for opening purposes while the locking cap device is locked, a torque imparted to the locking cap device is transmitted to the locking member, such that the locking member is liable to deform. Furthermore, a shaft of a driving device for actuating the locking member is apt to deform or damage due to shear force.

BRIEF SUMMARY OF THE INVENTION

An electric control device for a latch according to the present invention includes a mounting seat having including a first compartment and a second compartment. An electric locking device includes a bracket securely mounted in the second compartment and a driving member securely mounted to the bracket. The bracket includes a first face. The driving member is coupled with a locking member including a stop portion having a protrusive end. The protrusive end abuts the first face of the bracket without interfering with movement of the locking member. The driving member is configured to actuate the locking member. A locking cap device is pivotably connected to the mounting seat and is received in the first compartment. The locking cap device includes an inner side having a first protrusion corresponding to the stop portion. When the stop portion is located on a rotational path of the first protrusion, the locking cap device is not pivotable from a closure position to a non-closure position. When the stop portion is not located on the rotational path of the first protrusion, the locking cap device is pivotable relative to the mounting seat between the closure position and the non-closure position not closing the second opening.

In the electric control device according to the present invention, the bracket of the electric locking device is assembled to directly abut the inner face of the second compartment of the mounting seat, and each of the two locking members abuts the bracket. When each of the two locking members is located on the rotational path of the first or second protrusion, the two locking members are less likely to deform due to pressing by the first or second protrusion, reducing the possibility of damage to the two locking members.

In an example, the bracket includes a second face spaced from the first face, and wherein the second face abuts an inner face of the second compartment.

In an example, the inner face of the second compartment includes two coupling grooves. The bracket includes two outer ends. Each of the two outer ends includes a protrusion coupled with an associated one of the two coupling grooves.

In an example, the electric locking device further includes a status sensor. The bracket further includes a groove adjacent to the outer end and a recessed portion corresponding to the groove. The groove extends to the first face. The locking member is movably received in the groove. The stop portion of the locking member is located outside of the groove. The status sensor is received in the recessed portion without extending beyond the second face. The locking member includes an activation end interlocked with the status sensor. When the locking member moves from an extended position to a retracted position, the activation end activates the status sensor.

In an example, a detecting device movably received in the first compartment. The detecting device includes a supporting seat having a first side and a second side. The supporting seat further includes a recess between the first side and the second side and an assembling hole extending from the first side to the recess. The supporting seat further includes a receiving hole extending from the second side to the recess. A closure detection sensor is received in the recess. A fastener includes an enlarged portion and an extension arm extending from the enlarged portion. The extension arm includes a deformable end at a distal end thereof. The deformable end includes a slit in a central portion thereof and two tabs on two sides of the slit. The enlarged portion of the fastener is received in the receiving hole. The extension arm extends through the closure detection sensor. The deformable end is detachably coupled with the assembling hole. An actuation plate is pivotably connected to the supporting seat. The actuating plate is pivotable between a non-contact position not activating the closure detection sensor and a contact position activating the closure detection sensor.

In an example, the locking cap device includes a locking cap pivotably connected to the mounting seat and received in the first compartment. The locking cap includes an inner face having a plurality of positioning screw holes spaced from each other along a pivot axis of the locking cap. A first lining member includes a first slot extending along the pivot axis of the locking cap. The first lining member abuts the inner face of the locking cap. A threaded fastener extends through the first slot and in threading connection with one of the plurality of positioning screw holes. When the threaded fastener is tightened, the first lining member is not movable relative to the locking cap. When the threaded fastener is loosened, the first lining member is movable in an extent of the first slot relative to the locking cap.

In an example, the protrusive end is parallel to the first face of the bracket.

The present invention will become clearer in light of the following detailed description of illustrative embodiments of this invention described in connection with the drawings.

Figure 1:
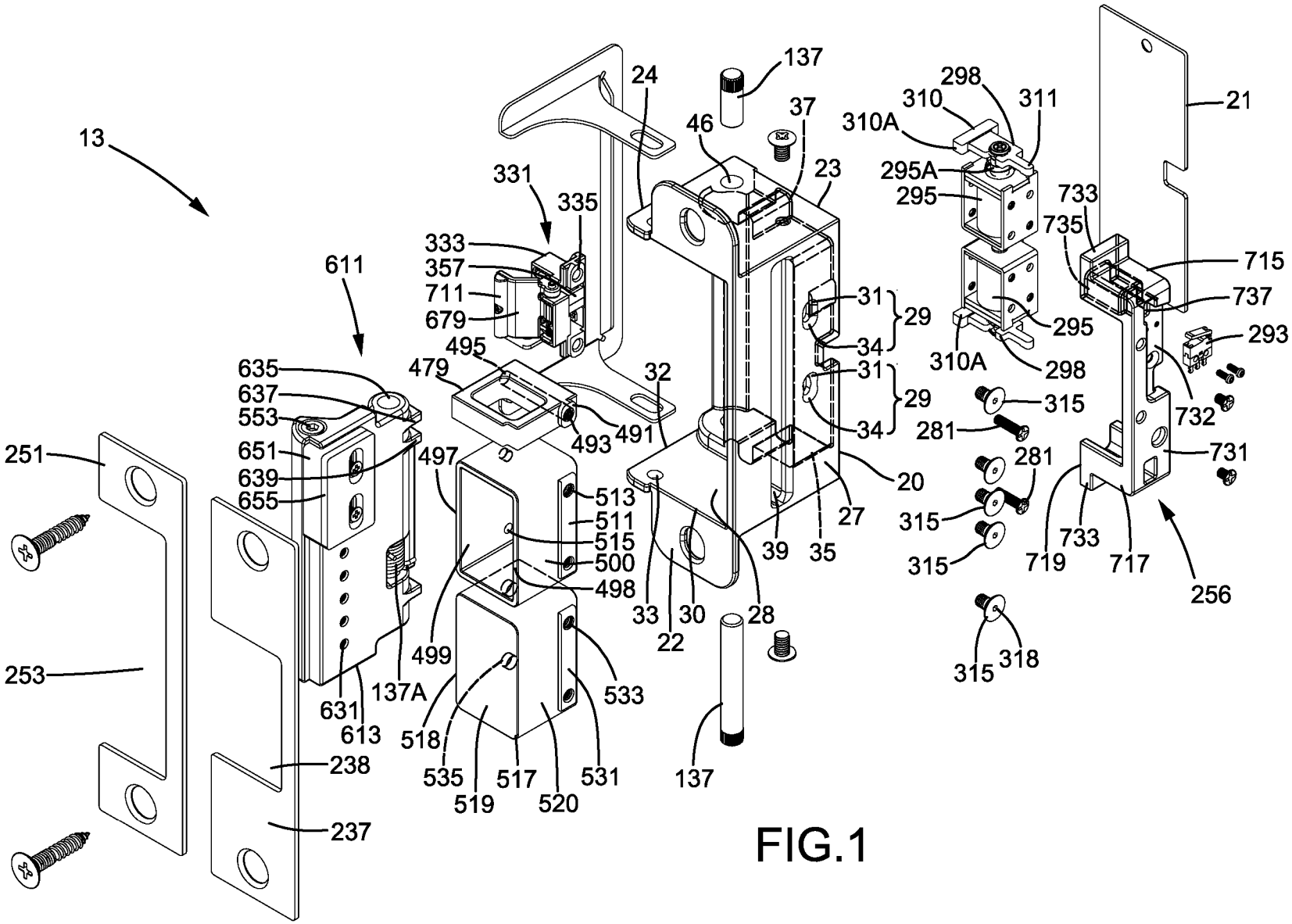
FIG. 1 is an exploded, perspective view of an electric control device for a latch according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "inner", "outer", "side", "end", "portion", "longitudinal", "lateral", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to the drawings, an electric control device 13 for a latch according to the present invention can be assembled into different modes according to different types of latch devices and can control locking or release of the latches of the latch devices.

The electric control device 13 includes a mounting seat 20 having a front face 22 and a rear face 23 opposite to the front face 22. The mounting seat 20 further includes first and second sides 24 and 27 extending between the front face 22 and the rear face 23 and opposite to each other (FIG. 1). The mounting seat 20 further includes a first compartment 28 extending from the front face 22 towards but spaced from the rear face 23 and a second compartment 35 extending from the rear face 23 to the first compartment 28 to thereby intercommunicate with the first compartment 28. The mounting seat 20 further includes a pivot hole 46 in an intersection of the first compartment 28 and the second compartment 36. Two coupling grooves 37 (FIG. 10) are formed in two opposite inner faces of the second compartment 35 spaced from each other along a longitudinal axis of the pivot hole 46.

The mounting seat 20 further includes a track 39 that is elongated and that extends from the second side 27 to the first compartment 28. The mounting seat 20 further includes two slots 29 spaced from the track 39 in a lateral direction and spaced from each other along the longitudinal axis of the pivot hole 46. Each of the two slots 29 extends along the longitudinal axis of the pivot hole 46 and includes a first end 31 and a second end 32. The mounting seat 20 further includes a first opening 30 defined in the front face 22 and intercommunicating with the first compartment 28. The mounting seat 20 further includes a second opening 32 defined in the first side 24, contiguous to the first opening 30, and intercommunicating with the first compartment 28. The mounting seat 20 further includes two pin holes 33 located adjacent to the second opening 32 and respectively defined in two wings extending from top and bottom sides thereof. The mounting seat 20 is configured to be mounted on an end face of a door frame (not shown).

Figure 2:
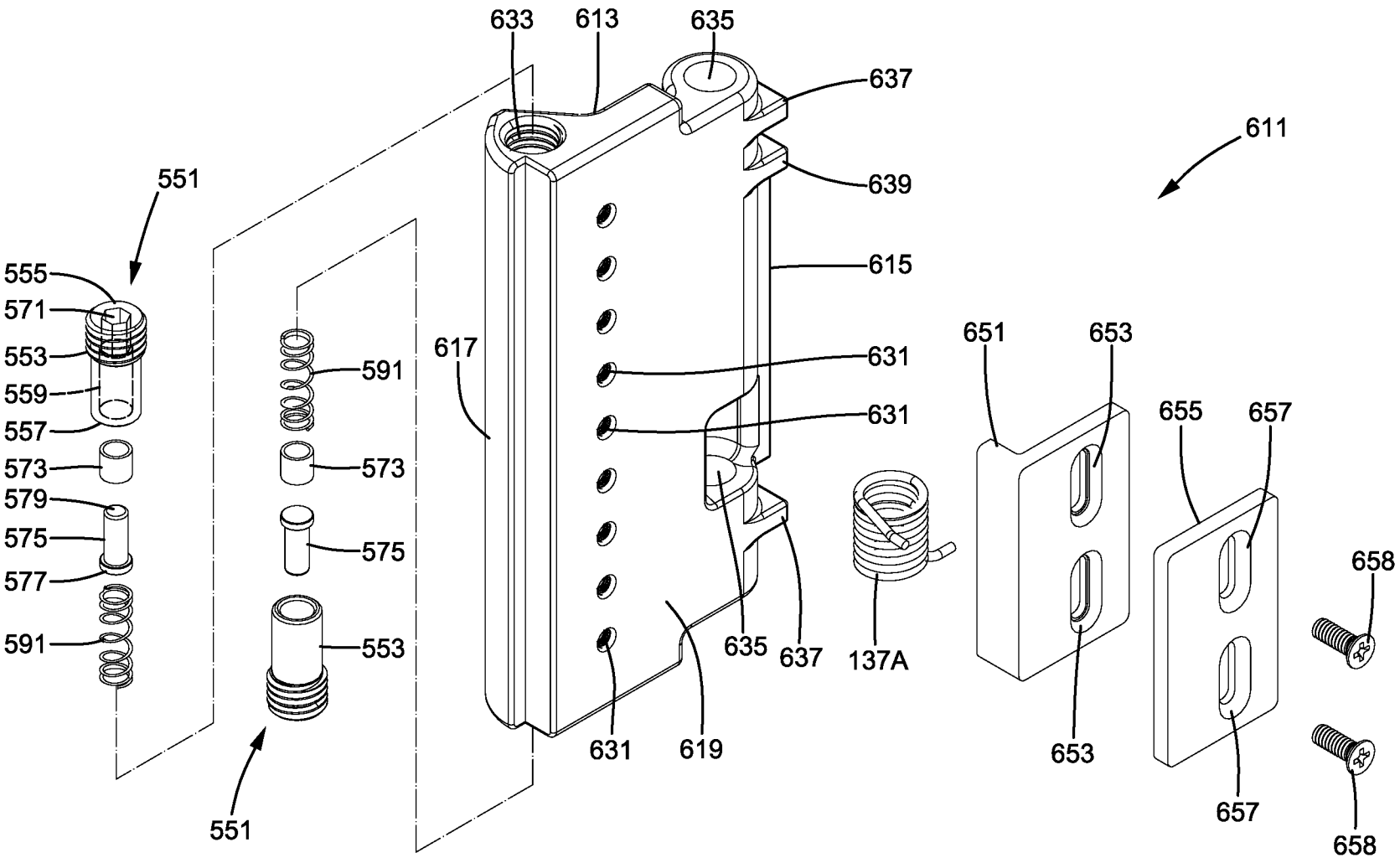
FIG. 2 is an exploded, perspective view of a locking cap device of the electric control device of FIG. 1.

With reference to FIG. 2, the electric control device 13 further includes a locking cap device 611 pivotably connected to the mounting seat 20. The locking cap device 611 includes a locking cap 613 having an outer side 617, an inner side 615, and inner face 619 extending between the inner side 615 and the outer side 617. The inner side 615 includes two pivotal holes 635 aligned with each other along the longitudinal axis of the pivot hole 46. The inner face 619 of the locking cap 613 includes a plurality of positioning screw holes 631 spaced from each other along the longitudinal axis of the pivot hole 46. The locking cap 613 further includes two first protrusions 637 disposed on two ends of an edge of the inner side 615 and a second protrusion 639 between the two first protrusions 637 and adjacent to one of the two first protrusions 637. The locking cap 613 further includes two receptacles 633 respectively in two end faces adjacent to the outer side 617. Each of the two receptacles 633 has an inner threading.

Figure 10:
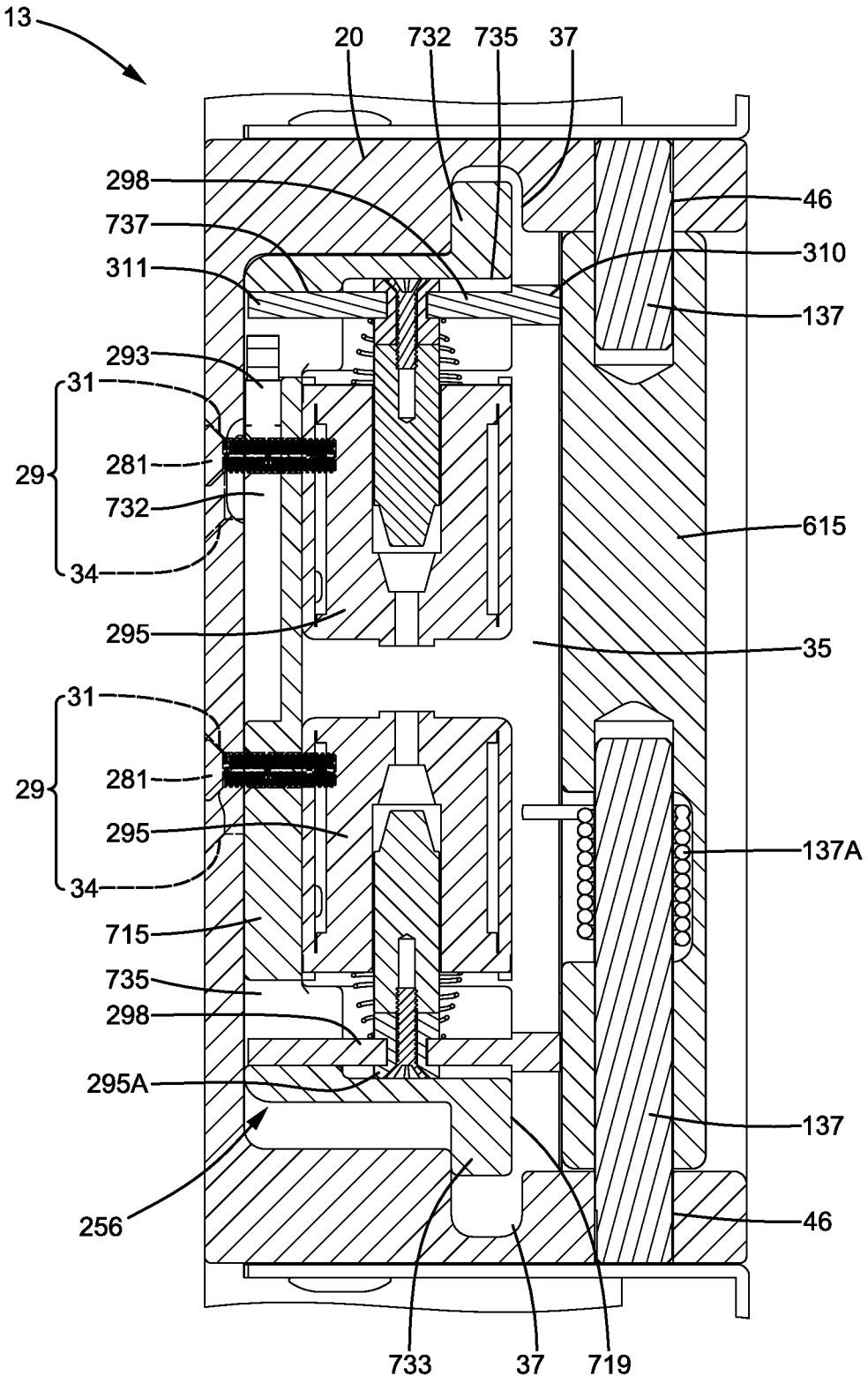
FIG. 10 is a cross sectional view taken along section line 10-10 of FIG. 6.
Figure 12:
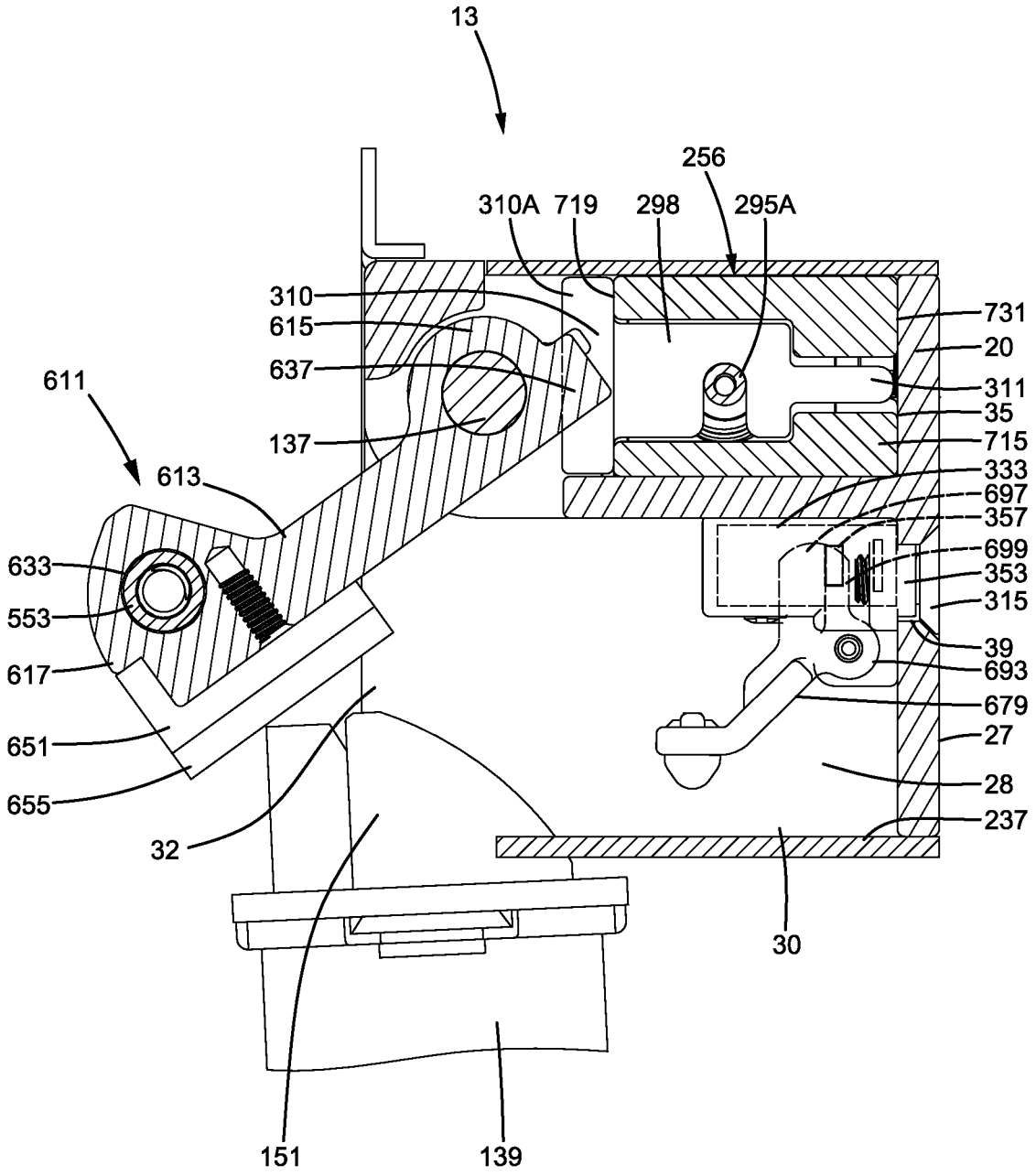
FIG. 12 is a view similar to FIG. 7 with the locking cap device, of the electric control device assembled into the first mode, pushed by the cylindrical latch device to a non-closure position.

The pivotal holes 635 of the locking cap 613 are aligned with the pivot hole 46 of the mounting seat 20. The inner face 619 faces the first compartment 28. Two pivots 137 extends through the pivot hole 46 and the pivotal holes 635 (FIG. 10). Thus, the locking cap 613 is pivotable relative to the mounting seat 20 between a closure position (FIGS. 6 and 7) and a non-closure position (FIG. 12). When the locking cap 613 is in the closure position, the locking cap 613 closes the second opening 32, the outer side 617 of the locking cap 613 is in the second opening 32, and the two receptacles 633 of the locking cap 613 are aligned with the two pin holes 33 of the mounting seat 20. On the other hand, when the locking cap 613 is in the non-closure position, the locking cap 613 reveals the second opening 32 (FIG. 12). A return spring 137A is mounted around the pivot 137 and is located between the locking cap 613 and the mounting seat 20. The return spring 137A biases the locking cap 613 to pivot relative to the mounting seat 20 toward the closure position.

The locking cap device 611 further includes a first lining member 651 and a second lining member 655. The first lining member 651 or both the first and second lining members 651 and 655 can be detachably mounted to a selective position on the inner face 619. The first lining member 651 includes two first slots 653 spaced from each other and extending along the longitudinal axis of the pivot hole 46. The second lining member 655 includes two second slots 657 spaced from each other and extending along the longitudinal axis of the pivot hole 46.

Figure 9:
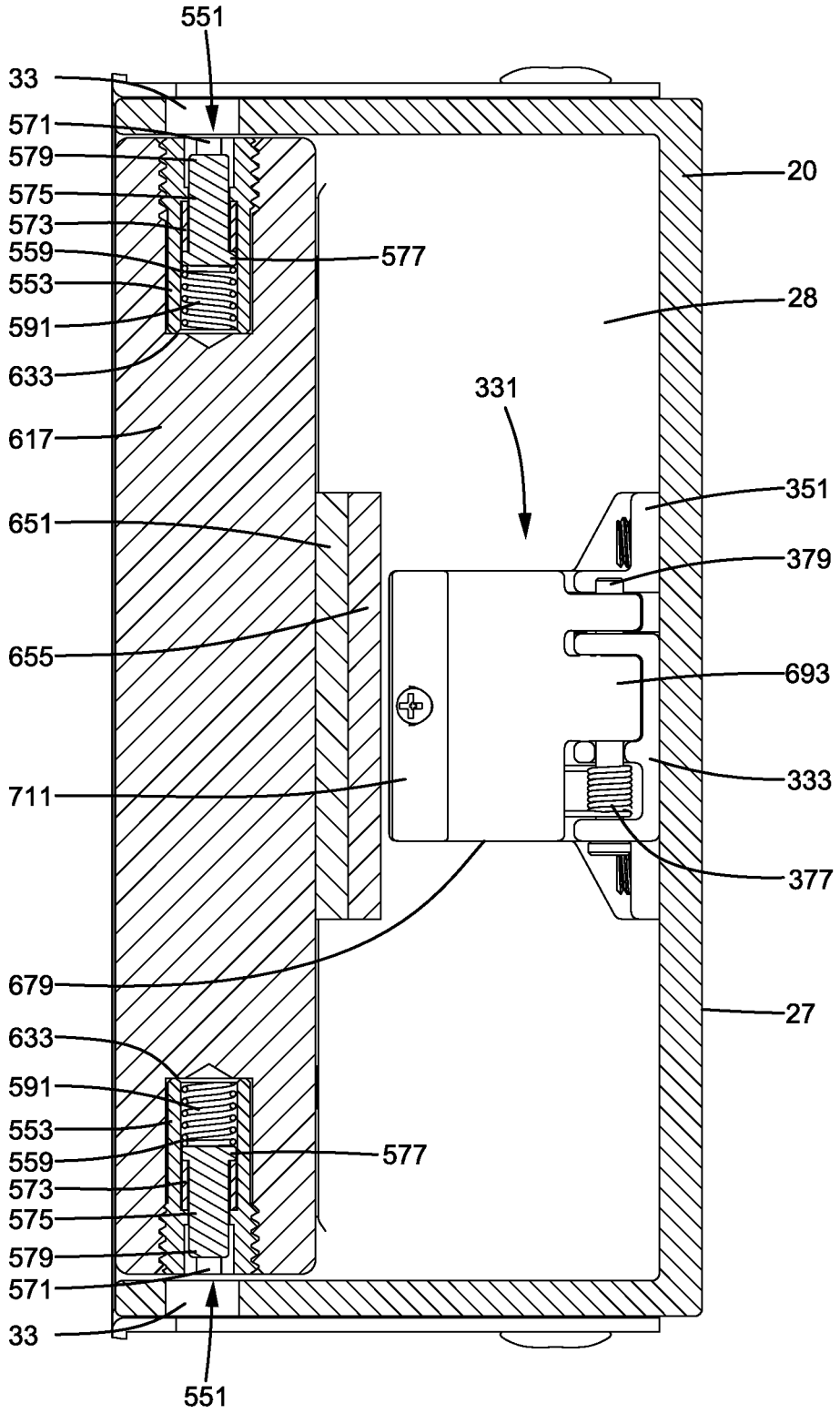
FIG. 9 is a cross sectional view taken along section line 9-9 of FIG. 7.

With reference to FIGS. 2 and 9, the locking cap device 611 further includes two high temperature locking devices 551. Each of the two high temperature locking devices 551 includes a higher melting point member 553 having an outer threading on an outer periphery thereof. Each higher melting point member 553 further includes an inner end 557 and an outer end 555. Each higher melting point member 553 further includes a smaller diameter hole section 571 extending from the outer end 555 towards but spaced from the inner end 557 and having hexagonal cross sections. Each higher melting point member 553 further includes a larger hole section 559 extending from the inner end 557 to the smaller hole section 571. Each higher melting point member 553 is made of a metal material having a higher melting point and is threadedly engaged in an associated one of the two receptacles 633 of the locking cap 613.

Each of the two high temperature locking devices 551 further includes a lower melting point member 573 with a melting point lower than the melting point of the higher melting point member 553 and a pin 575. Each lower melting point member 573 is cylindrical and has an outer diameter smaller than the diameter of the larger hole section 559 and larger than the diameter of the smaller hole section 571. Each lower melting point member 573 can be made of plastic material. Each pin 575 includes an enlarged end 577 having an outer diameter smaller than the diameter of the larger diameter hole section 559 and larger than the diameter of the smaller hole section 571. Each pin 575 further includes a coupling end 579 extending from an end face of the enlarged end 577. Each coupling end 579 has an outer diameter slightly smaller than the diameter of the smaller hole section 571 and is received in the smaller hole section 571.

Figure 16:
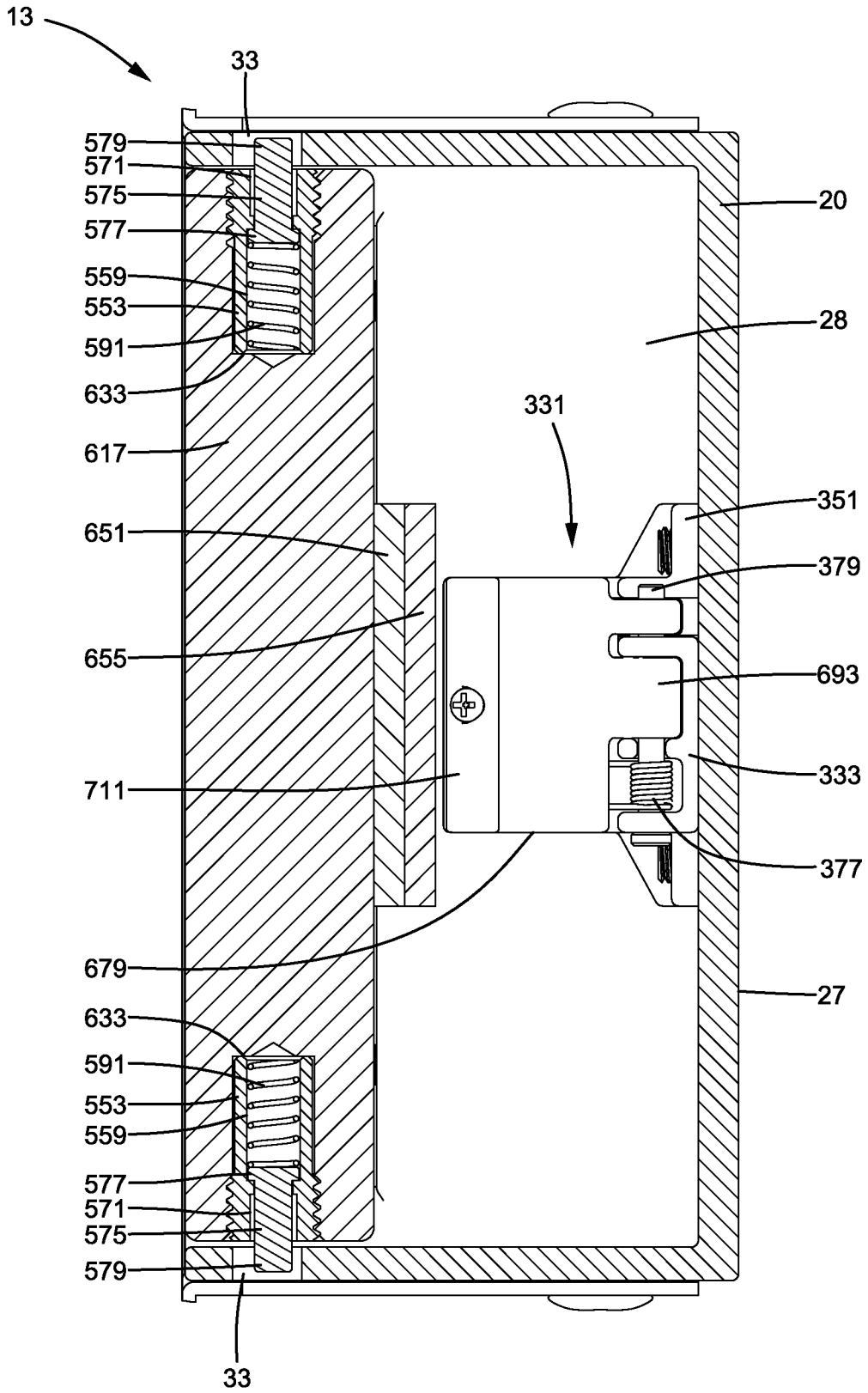
FIG. 16 is a cross sectional view illustrating the locking cap device in a closure position while two pins engaged with two pin holes of two high temperature locking device.

Each lower melting point member 573 and an associated pin 575 are received in the larger hole section 559 of an associated higher melting point member 553, with the lower melting point member 573 located between the smaller hole section 571 and the enlarged end 577 of the associated pin 575. The enlarged end 577 of each pin 575 is pressed by an ejection spring 591. Each ejection spring 591 presses an associated pin 575 towards the smaller hole section 571 of an associated higher melting point member 553. Before each lower melting point member 573 melts, the coupling end 579 of each pin 575 is located in the smaller hole section 571 of the associated higher melting point member 553 (see FIG. 9). After each lower melting point member 573 melts, each ejection spring 591 pushes the associated pin 575 to move along the larger hole section 559 until the coupling end 579 of the associated pin 575 is outside of the smaller hole section 571 (see FIG. 16).

The locking cap device 611 can be selectively coupled with the first lining member 651 or both the first lining member 651 and the second lining member 655. In a case that only the first lining member 651 is selected (see FIG. 19), the two threaded fasteners 658 extend through the two first slots 653 into two of the plurality of positioning screw holes 631. The coupling position of the first lining member 651 on the inner face 619 of the locking cap 613 can be adjusted by the selected two positioning screw holes 631. When the two threaded fasteners 658 are tightened, the first lining member 651 cannot move relative to the locking cap 613. When the two threaded fasteners 658 are loosened, the first lining member 651 can move within the length of each first slot 653 relative to the locking cap 613 for adjusting the position.

In another case that both the first lining member 651 and the second lining member 655 are selected (see FIG. 6), the first lining member 651 abuts the inner face 619 of the locking cap 613, and the second lining member 655 abuts a surface of the first lining member 651. Then, the two threaded fasteners 658 extend through the two first slots 653 and the two second slots 657 into two of the plurality of positioning screw holes 631. The coupling position of the first lining member 651 and the second lining member 655 on the inner face 619 of the locking cap 613 can be adjusted by the selected two positioning screw holes 631. When the two threaded fasteners 658 are tightened, the first lining member 651 and the second lining member 655 cannot move relative to the locking cap 613. When the two threaded fasteners 658 are loosened, the first lining member 651 and the second lining member 655 can move within the length of each first slot 653 and each second slot 657 relative to the locking cap 613 for adjusting the position.

With reference to FIG. 1, the electric control device 13 further includes a first accessory 479, a second accessory 497, a third accessory 517, a first escutcheon 237, and a second escutcheon 251, all of which are optional and can be selected according to different needs. The first accessory 479 is in the form of a narrow frame having substantially rectangular cross sections. The first accessory 479 includes a first side having a first sliding block 491 with a first threaded hole 493. The first accessory 479 further includes a first through-hole 495 defined in a second side thereof opposite to the first side having the first sliding block 491, with the first through hole 495 aligned with the first threaded hole 493. The second accessory 497 includes an end wall 498, an installation wall 500 opposite to the end wall 498, and a locking latch hole 499 between the end wall 498 and the installation wall 500. A second sliding block 511 is disposed on the installation wall 500 and includes two second threaded holes 513. The end wall 498 includes two through-holes 515 respectively aligned with the two second threaded holes 513. The third accessory 517 includes a sidewall 518, an assembling wall 520 opposite to the sidewall 518, and an outer wall 519 extending between the sidewall 518 and the assembling wall 520. The sidewall 518 includes two third through-holes 535. The assembling wall 520 includes a sliding block 531 having two third threaded holes 533 aligned with the two third through-holes 535.

One of the first escutcheon 237 and the second escutcheon 251 is selectively mounted to the front face 22 of the mounting seat 20. As shown in FIG. 1, the first escutcheon 237 includes a first outlet 238 smaller than the first opening 30. The first outlet 238 is open in an edge of the first escutcheon 237. The second escutcheon 251 includes a second outlet 253 larger than the first outlet 238 and substantially equal to the first opening 30. The second outlet 253 is open in an edge of the second escutcheon 251.

Figure 4:
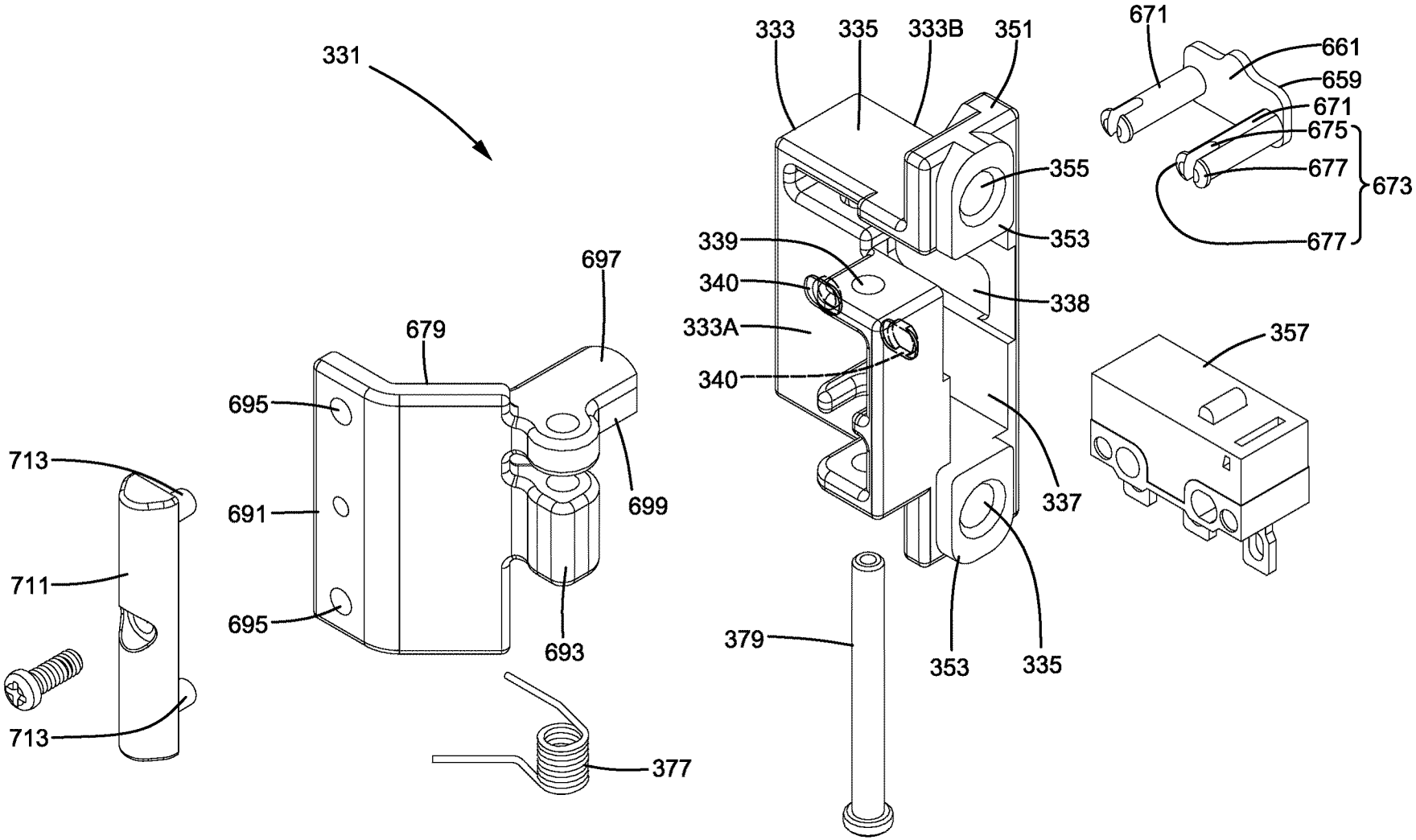
FIG. 4 is an exploded, perspective view of a detecting device of the electric control device of FIG. 1.
Figure 5:
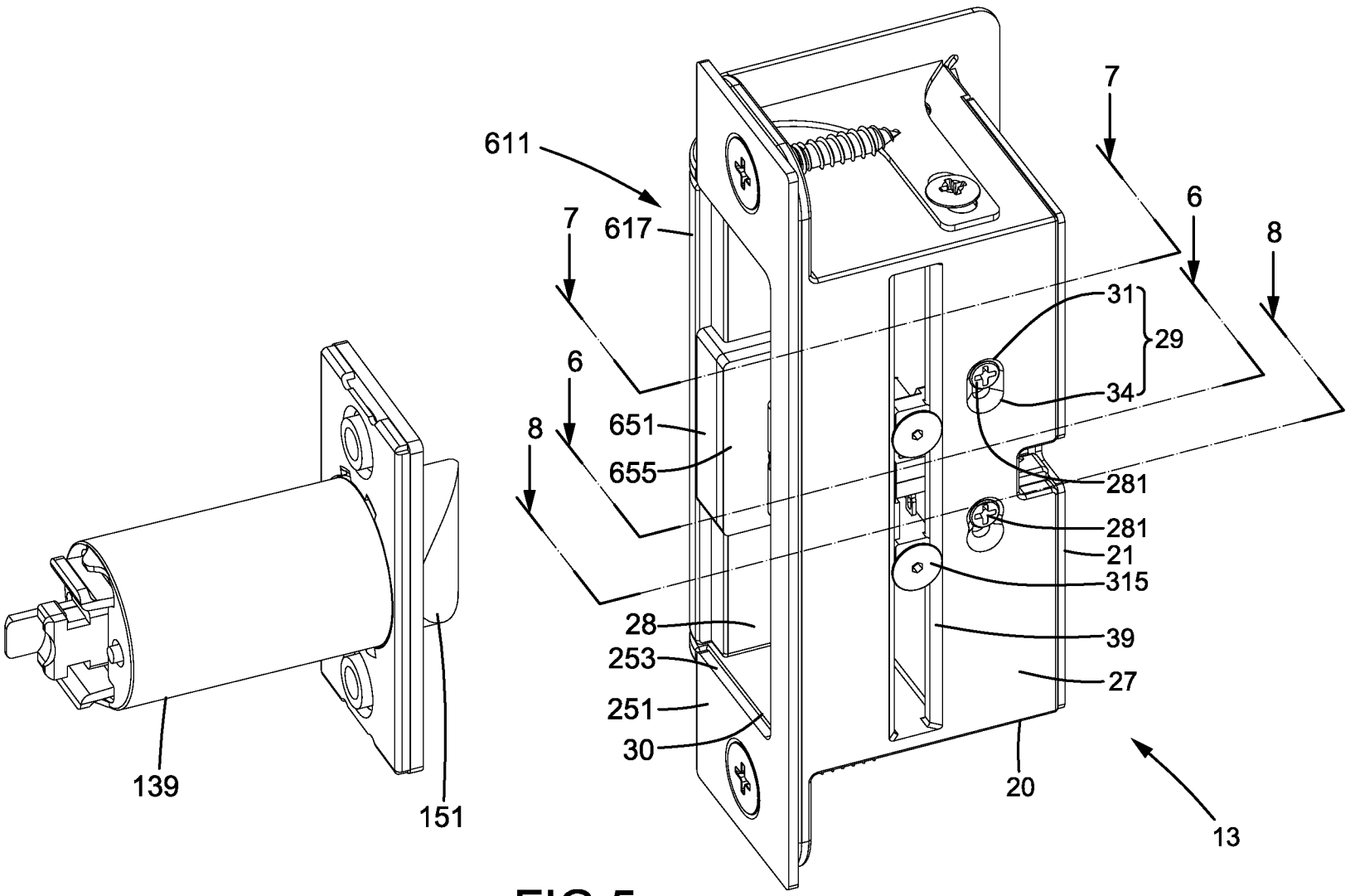
FIG. 5 is an exploded, perspective view of the electric control device assembled into a first mode and a cylindrical latch device.

With reference to FIG. 4, the electric control device 13 further includes a detecting device 331 received in the first compartment 28. The detecting device 331 includes a supporting seat 333. The supporting seat 333 includes a body 335 and two engaging portions 351 on two outer sides of the body 335. Each of the two engaging portions 351 includes an end face having a sliding portion 353 with a screw hole 355. The supporting seat 333 further includes a first side 333A and a second side 333B spaced from the first side 333A. The supporting seat 333 further includes a recess 337 between the first side 333A and the second side 333B and a pivotal portion 339 outside of the recess 337. The first side 333A includes two assembling holes 340 extending to the recess 337. The second side 333B includes a receiving hole 338 extending to the recess 337.

Figure 13:
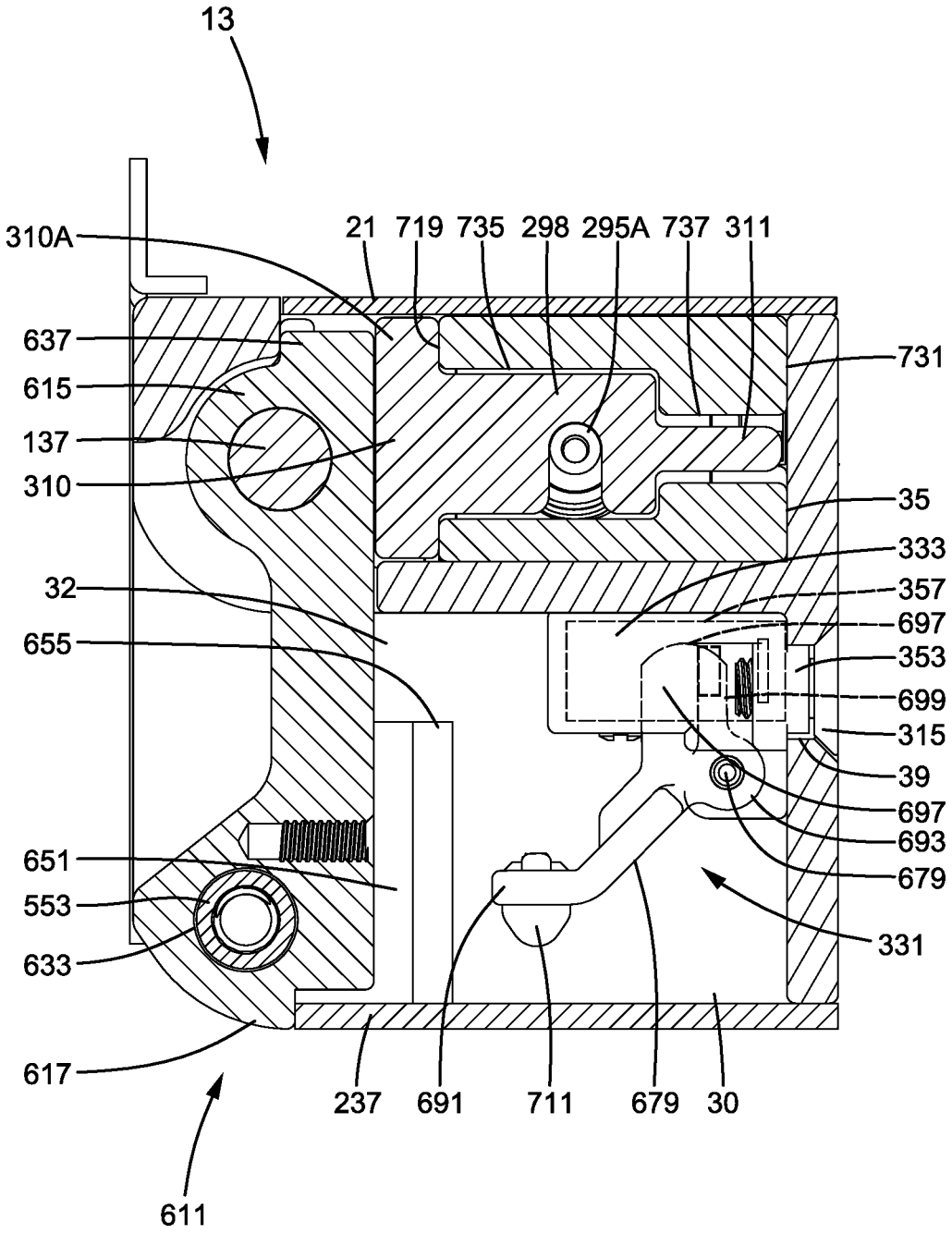
FIG. 13 is a view similar to FIG. 7 with the cylindrical latch device detached from the electric control device assembled into the first mode.

The detecting device 331 further includes an actuation plate 679 and a closure detection sensor 357. The actuation plate 679 includes a pivotal end 693 and an actuating end 691. The actuation plate 679 further includes a lug 697 on a side of the pivotal end 693 and two alignment holes 695 on the actuating end 691. The lug 697 includes a protrusion 699. The pivotal end 693 of the actuation plate 679 is pivotably coupled with the pivotal portion 339 of the supporting seat 333. An axle 379 extends through the pivotal portion 339 of the supporting seat 333, such that the actuating plate 679 is pivotable relative to the supporting seat 333 to a non-contact position (FIGS. 6-8) or a contact position (FIGS. 12 and 13). A bias spring 377 is mounted around the axle 379 and is located between the actuation plate 679 and the supporting seat 333. The bias spring 377 biases the actuation plate 679 to the non-contact position.

The actuating end 691 of the actuation plate 679 can be selectively coupled with an attachment member 711 having two alignment pins 713. The attachment member 711 abuts the actuating end 691 of the actuation plate 679, and the two alignment pins 713 are coupled with the two alignment holes 695. A screw is used to precisely fix the attachment member 711.

Figure 8:
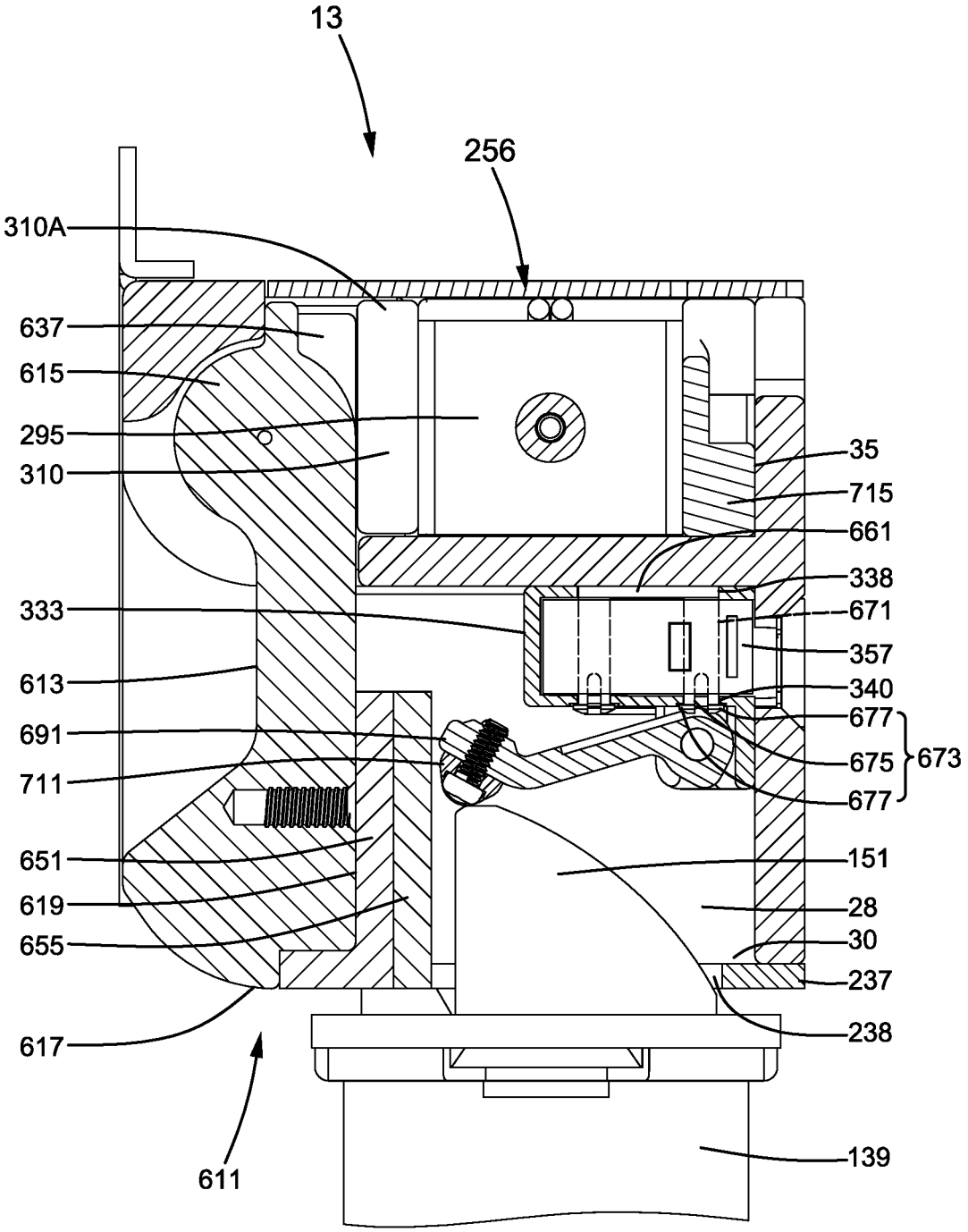
FIG. 8 is a cross sectional view taken along section line 8-8 of FIG. 5.

The closure detection sensor 357 is comprised of a micro switch and is received in the recess 337. The detecting device 331 further includes a fixing member 659 having an enlarged portion 661 and two extension arms 671 extending from the enlarged portion 661. Each of the two extension arms 671 includes a deformable end 673 at a distal end thereof. Specifically, each of the two extension arms 671 includes a slit 675 extending from a central portion of the distal end of the extension arm 671 to form two tabs 677 on two sides of the slit 675. When the two tabs 677 are pressed, the two tabs 677 can elastically deform towards the slit 675. Each of the two extension arms 677 of the fixing member 659 extends through the closure detection sensor 357, and the deformable ends 673 of the two extension arms 671 deform while passing through the two assembling holes 340 and restore the original shape after passing through two fixing holes 340, thereby engaging with the assembling holes 340 to prevent disengagement of the two extension arms 671. The fixing member 659 is received in the receiving hole 338. Thus, the closure detection sensor 357 is secured in the recess 337. With reference to FIG. 8, when the actuation plate 679 is in the non-contact position, the protrusion 699 is spaced from and, thus, does not press against a button of the closure detection sensor 357 by the fixing member 659. With reference to FIGS. 12 and 13, when the actuation plate 679 is in the contact position, the lug 697 of the actuation plate 679 presses against the button of the closure detection sensor 357 to activate the closure detection sensor 357.

Figure 6:
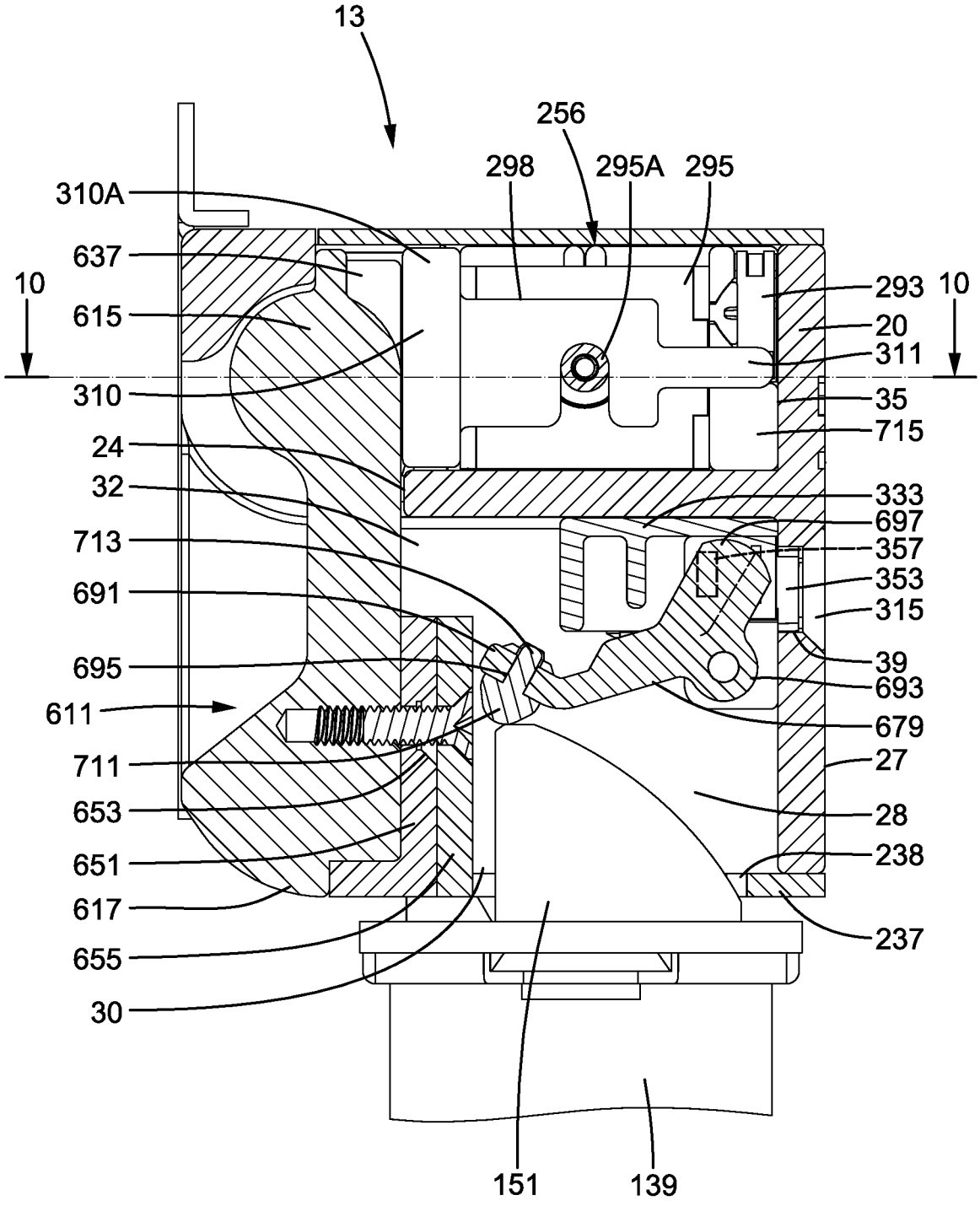
FIG. 6 is a cross sectional view taken along section line 6-6 of FIG. 5 after assembly.
Figure 17:
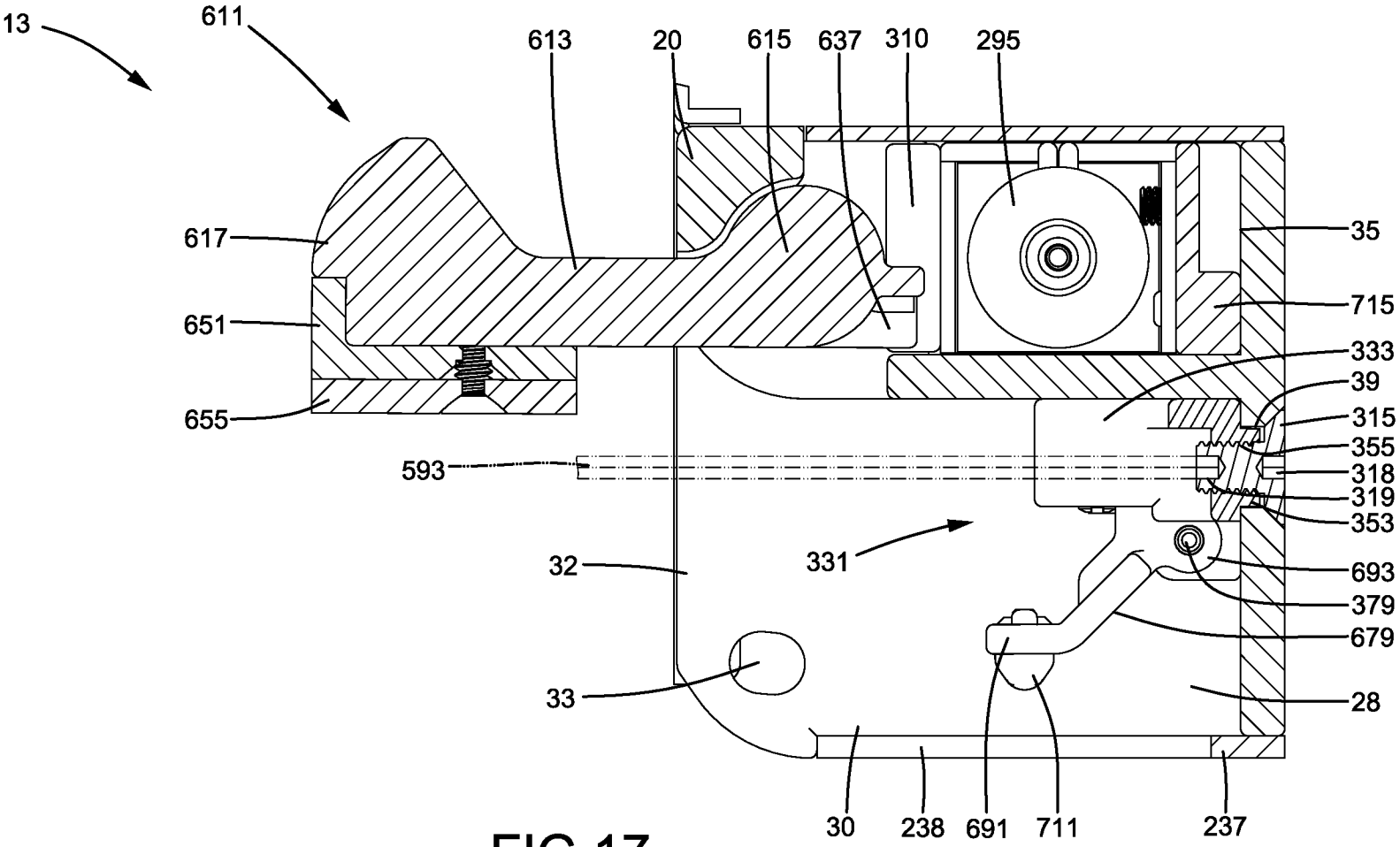
FIG. 17 is a cross sectional view illustrating the locking cap device moved to a non-closure position while using a hand tool to rotate the fixing screw.

The detecting device 331 is received in the first compartment 28. The two sliding blocks 353 of the supporting seat 333 of the detecting device 331 are aligned with the track 39 of the mounting seat 20 (FIGS. 6 and 17). The detecting device 331 is movable along the track 39 to a desired position. Then, two of a plurality of fixing screws 315 extends through the track 39 to engage with the screw holes 355 of the supporting seat 333. Thus, the detecting device 331 is fixed to the selected position according to the type of latch device cooperating with the electric control device 13.

Figure 3:
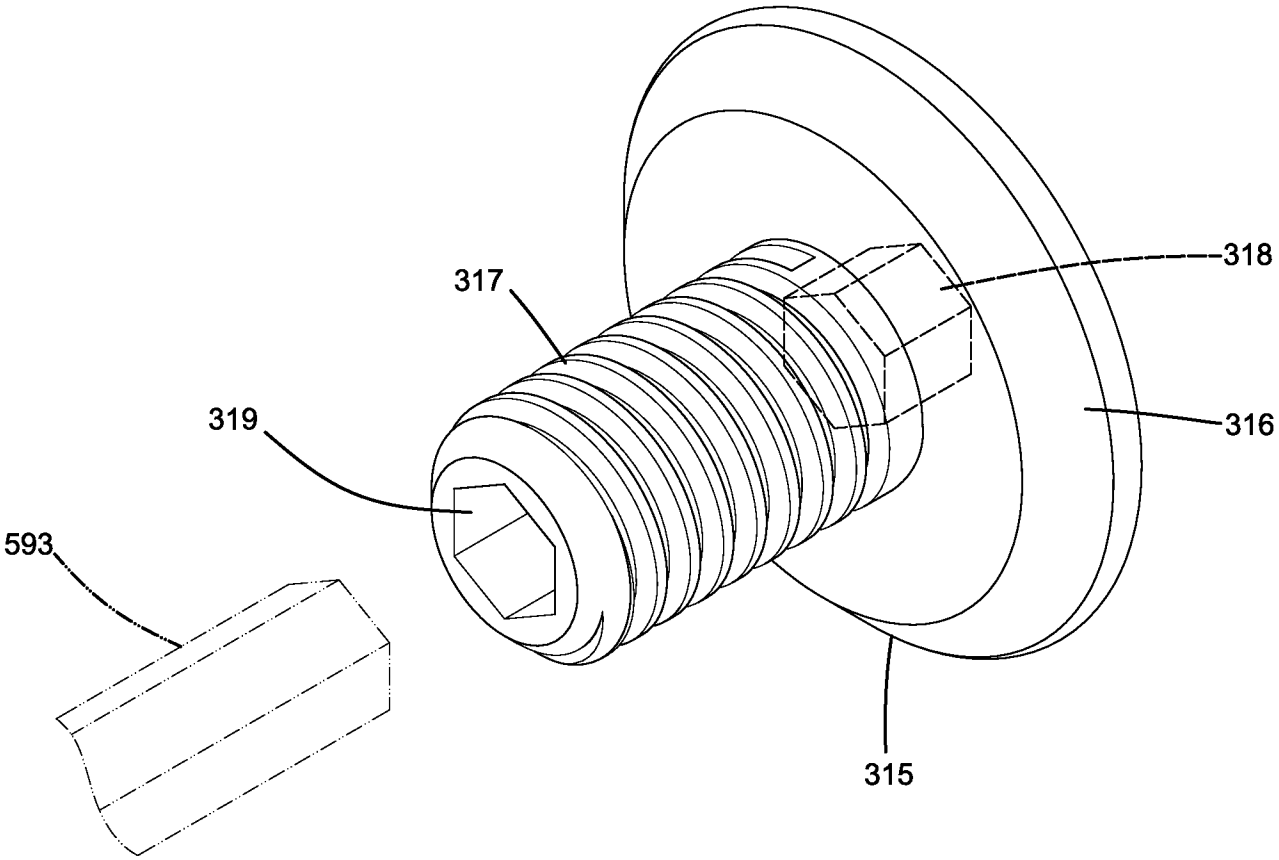
FIG. 3 is a perspective view of a fixing screw.

With reference to FIG. 3, each of the plurality of fixing screws 315 includes a head 316 and a shank 317 extending from the head 316. The head 316 has a first driving hole 318. The shank 317 includes an end face having a second driving hole 319. The first driving hole 318 and the second driving hole 319 have hexagonal cross sections. Furthermore, the track 39 of the mounting seat 20 is slightly smaller than the head 316 of each of the plurality of fixing screws 315, such that the head 316 can be received in an enlarged section of the track 39 but cannot passes through the track 39 (see FIG. 6). After using a hand tool 593 to engage with the first driving holes 318 of two of the plurality of fixing screws 315 (which are threadedly engaged with the two screw holes 355 of the supporting seat 333) to thereby tighten these two fixing screws 315, the supporting seat 333 of the detecting device 331 cannot move along the track 39. When these two fixing screws 315 (which are threadedly engaged with the two screw holes 355 of the supporting seat 333) are loosened by using the hand tool 593 (see FIG. 17), the position of the detecting device 331 can be adjusted by moving along the track 39.

The electric control device 13 further includes an electric locking device 256 received in the second compartment 35. The electric locking device 256 includes a bracket 715 having a first face 719 and a second face 731 spaced from the first face 719. The bracket 715 further includes two outer ends 717 and two protrusions 733 protruding outward from the two outer ends 717, respectively. The second face 731 includes a recessed portion 732 extending towards but spaced from the first surface 719. The bracket 715 further includes two grooves 735 adjacent to the two outer ends 717, respectively. A through-hole 737 is formed between the recessed portion 732 and one of the two grooves 735 (e.g., an upper one of the two grooves 735 shown in FIG. 1). The recessed portion 732 is used to fix a status sensor 293 which can be, but not limited to, a micro switch having an actuation button facing the through-hole 737 (see FIG. 14). It is noted that the status sensor 293 received in the recessed portion 732 is located on an inner side of the second face 731.

The electric locking device 256 further includes two driving members 295 mounted on the bracket 715 and two locking members 298 respectively driven by the two driving members 295. Specifically, the two driving members 295 are disposed between the first face 719 and the second face 731 and between the two outer ends 717. Each of the two driving members 295 includes a shaft 295A and can be in the form of an electromagnetic valve that provides an electromagnetic force for driving the shaft 295A to move rectilinearly. Each of the two locking members 298 includes a stop portion 310 and an activation end 311 spaced from the stop portion 310. Each stop portion 310 includes two protrusive ends 310A parallel to the first face 719 of the bracket 715. Each of the two locking members 298 is coupled to one of the two driving members 295 and is movably received in an associated groove 735 along the longitudinal axis of the pivot hole 46. Furthermore, the activation end 311 of one of the two locking members 298 (the upper one in FIG. 1) extends through the through-hole 737 into the recessed portion 732 and is located above the status sensor 293. Furthermore, the two protrusive ends 310A of the stop portion 310 of each of the two locking members 298 are located outside of the support 715 and abut the first face 719 without interfering with the movement of the locking member 298. Each of the two driving members 295 can drive a respective locking member 298 between a retracted position (FIG. 10) and an extended position (FIG. 9).

The electric locking device 256 is received in the second compartment 35 of the mounting seat 20. Since the status sensor 293 is located on the inner side of the second face 731 (without extending beyond the second face 731), the second face 731 of the bracket 715 completely abuts a surface of the second compartment 35. The two protrusions 733 of the bracket 715 engage with the two coupling grooves 37 of the second compartment 35, respectively. The second face 731 of the bracket 715 is aligned with the two slots 29. Two screws 281 extend through the two slots 29 to be in threading connection with the bracket 715. When the two screws 281 are not tightened, the electric locking device 256 can move within the lengths of the two slots 29 along the longitudinal axis of the pivot hole 46. When the two screws 281 are tightened, the electric locking device 256 is fixed and not movable relative to the mounting eat 20. Furthermore, a lid 21 is disposed to the rear face 23 of the mounting seat 20 to close the second compartment 35.

Figure 14:
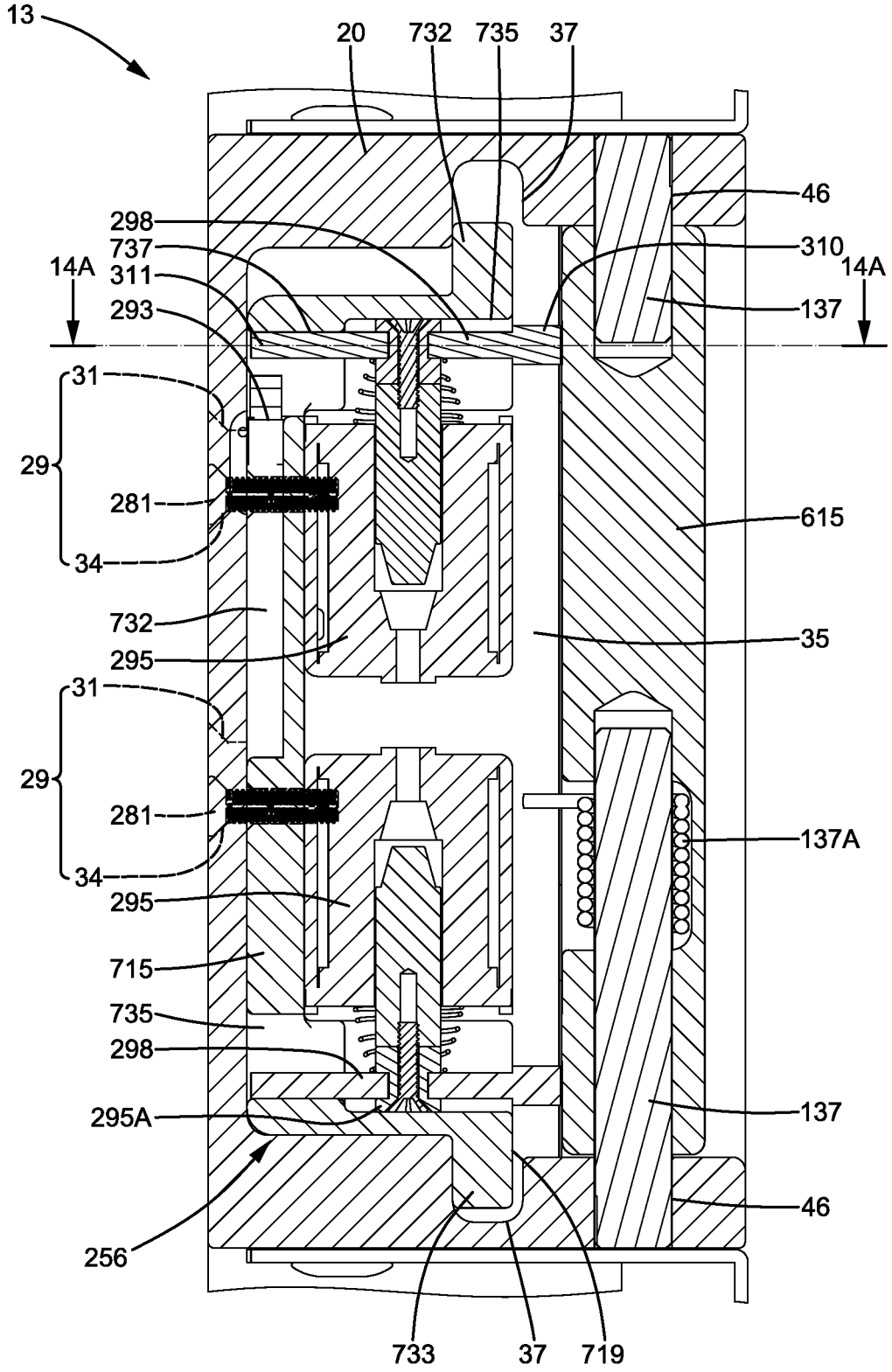
FIG. 14 is a cross sectional view of the electric control device installed in a second position and with the locking member in an extended position.
Figure 14A:
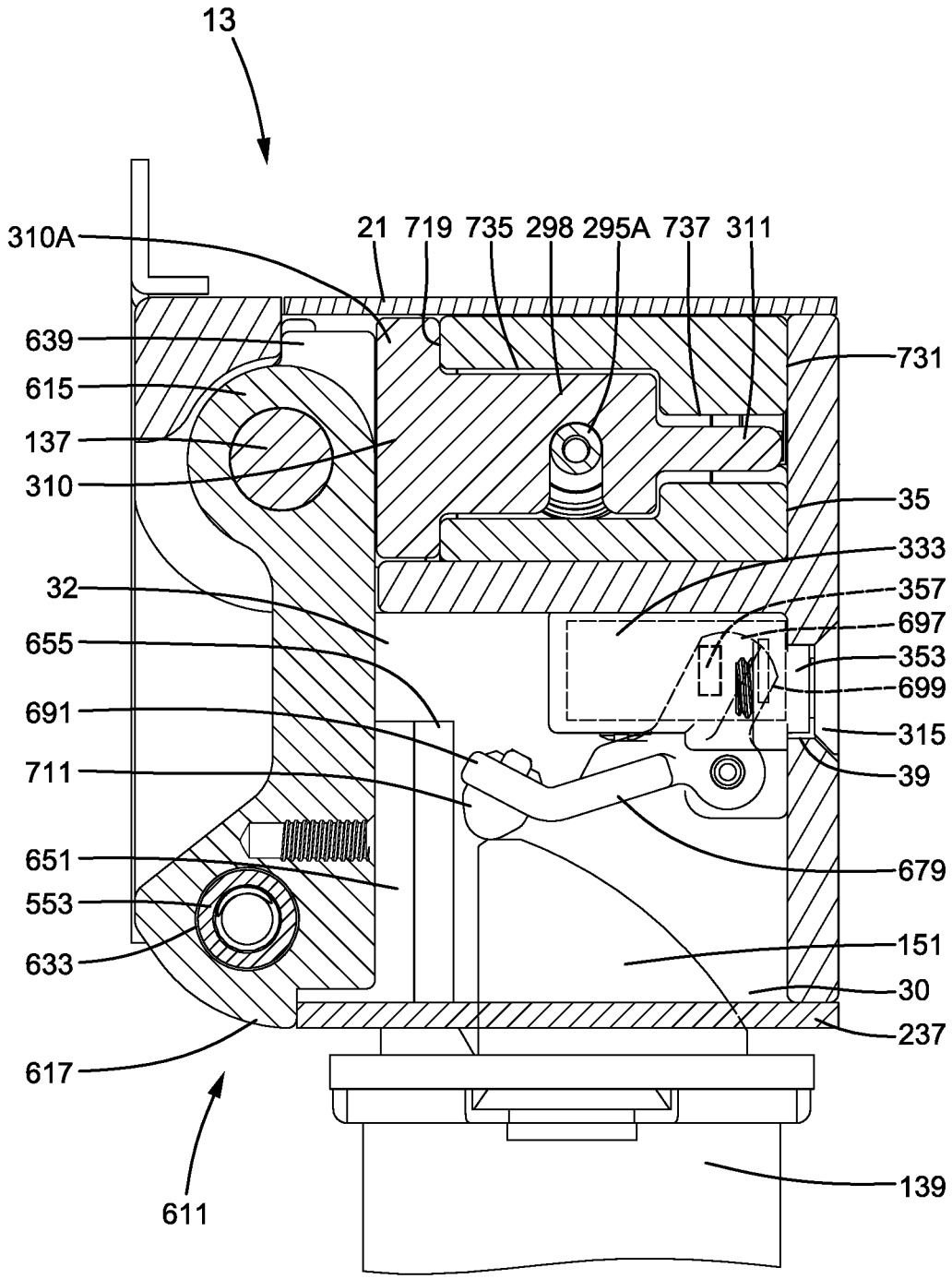
FIG. 14A is a cross sectional view taken along section line 14A-14A of FIG. 14.

With the two screws 281 not tightened, when the electric locking device 256 moves to a position in which each of the two screws 281 is located in the first end 31 of an associated slot 29 (the first position), the stop portion 310 of each of the two locking members 298 is misaligned from an associated first protrusion 637 of the locking cap device 611, such that the electric locking device 256 is in a normally open state (see FIGS. 14 and 14A). Furthermore, one of the locking member 298 is located between an associated first protrusion 637 and the second protrusion 639. On the other hand, with the two screws 281 not tightened, when the electric locking device 256 moves to a position in which each of the two screws 281 is located in the second end 34 of an associated slot 29 (the first position), the stop portion 310 of each locking member 298 is aligned with an associated first protrusion 637 of the locking cap device 611, such that the electric locking device 256 is in a normally closed state (see FIGS. 6 and 10).

Through adjustment and locations of the components in the first compartment 28, the electric control device 13 can be assembled into one of a plurality of different modes for cooperating with different types of latch devices. With reference to FIGS. 5-8, in a case that the electric control device 13 is assembled into a first mode for cooperating with the cylindrical latch device 139, the electric locking device 256 is installed in the second position that is normally closed (FIG. 10).

Since the cylindrical latch device 139 includes only one latch 151, the first accessory 479, the second accessory 497, and the third accessory 517 are not mounted in the first compartment 28. Thus, the first compartment 28 only receives the detecting device 331. Furthermore, the first escutcheon 237 is mounted to cooperate with the cylindrical latch device 139 (see FIG. 5), and the first outlet 238 of the first escutcheon 237 is substantially located in a center of the first opening 30. Furthermore, the first opening 30 is partially covered by the first escutcheon 237. Since the size of the first outlet 238 is slightly larger than the latch 151 of the cylindrical latch device 139, the latch 151 is permitted to pass through the first outlet 238 into the first compartment 28. Furthermore, since the latch 151 is located in the center of the first compartment 28, after loosening two of the plurality of fixing screws 315, the detecting device 331 can be adjusted to a position substantially in the center of the first compartment 28 and aligns with the first outlet 238 of the first escutcheon 237 (FIG. 6), and these two fixing screws 315 are retightened to fix the detecting device 331.

When the first accessory 479 or the second accessory 497 is not in a correct position and when the locking cap device 611 is in the non-closure position, the hand tool 593 can pass through the first through-hole 495 of the first accessory 479 to engage with the second driving hole 319 of an associated fixing screw 315, or can pass through each second through-hole 515 of the second accessory 497 to engage with the second driving hole 319 of each associated fixing screw 315. Thus, the hand tool 593 can loosen each associated fixing screw 315 and can adjust the position of the first accessory 479 and/or the second accessory 497. When the correct position is reached, each associated fixing screw 315 can be tightened to fix the first accessory 479 and/or the second accessory 497.

Furthermore, when the first lining member 651 and the second lining member 655 corresponding to the size of the latch 151 of the cylindrical latch device 139 are selected and are mounted to the inner face 619 of the locking cap 613, and the two threaded fasteners 658 extend through the first and second slots 653 and 657 into two positioning screw holes 631 near the central portion of the locking cap 613. Thus, the first and second lining members 651 and 655 are fixed in a location near the central portion of the locking cap 613. When the two threaded fasteners 658 are not tightened, the position of the first lining member 651 and the second lining member 655 can be adjusted relative to the locking cap 613 can be adjusted within the extent of the first and second slots 653 and 657.

Figure 7:
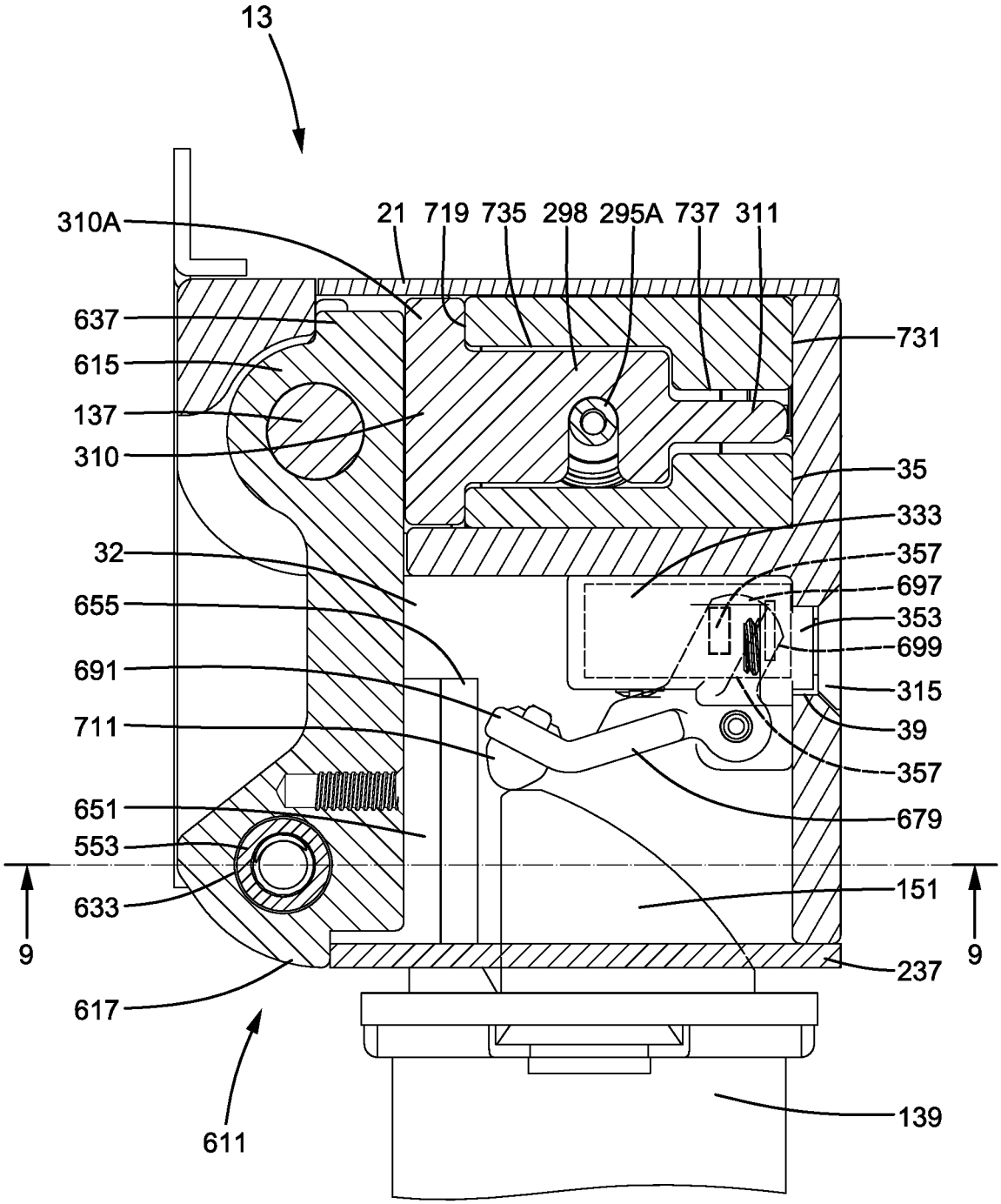
FIG. 7 is a cross sectional view taken along section line 7-7 of FIG. 5.

With reference to FIGS. 6-8, when the door is closed, the latch 151 of the cylindrical latch device 139 is received in the first compartment 28 of the mounting seat 20. The attachment member 711 is pressed by the latch 151 to move the actuation plate 679 to the non-contact position. The protrusion 699 of the actuation plate 679 is spaced from the button of the closure detection sensor 357. Thus, the door is detected to be in the closed position.

Assuming that the latch 151 of the cylindrical latch device 139 is in the first compartment 28 and the locking cap device 611 is in the closure position, when the two locking members 298 of the electric locking device 256 are in the extended position (FIG. 10), the stop portion 310 of each of the two locking members 298 is on a rotational path of an associated first protrusion 637 (each stop portion 310 is in a blocking position blocking rotational movement of the associated first protrusion 637 and each of the two locking members 298 is below the associated first protrusion 637 along the pivot hole 46, see FIG. 7), such that the locking cap device 611 is locked by the electric locking device 256 and, thus, cannot move from the closure position to the non-closure position. Namely, the locking cap device 611 is retained in the closure position. The movement path of the latch 151 of the cylindrical latch device 139 for disengaging from the electric control device 13 is restrained by the locking cap device 611. Furthermore, the latch 151 of the cylindrical latch device 139 cannot disengage from the first compartment 28. Accordingly, the door is locked and, thus, cannot be opened.

Figure 11:
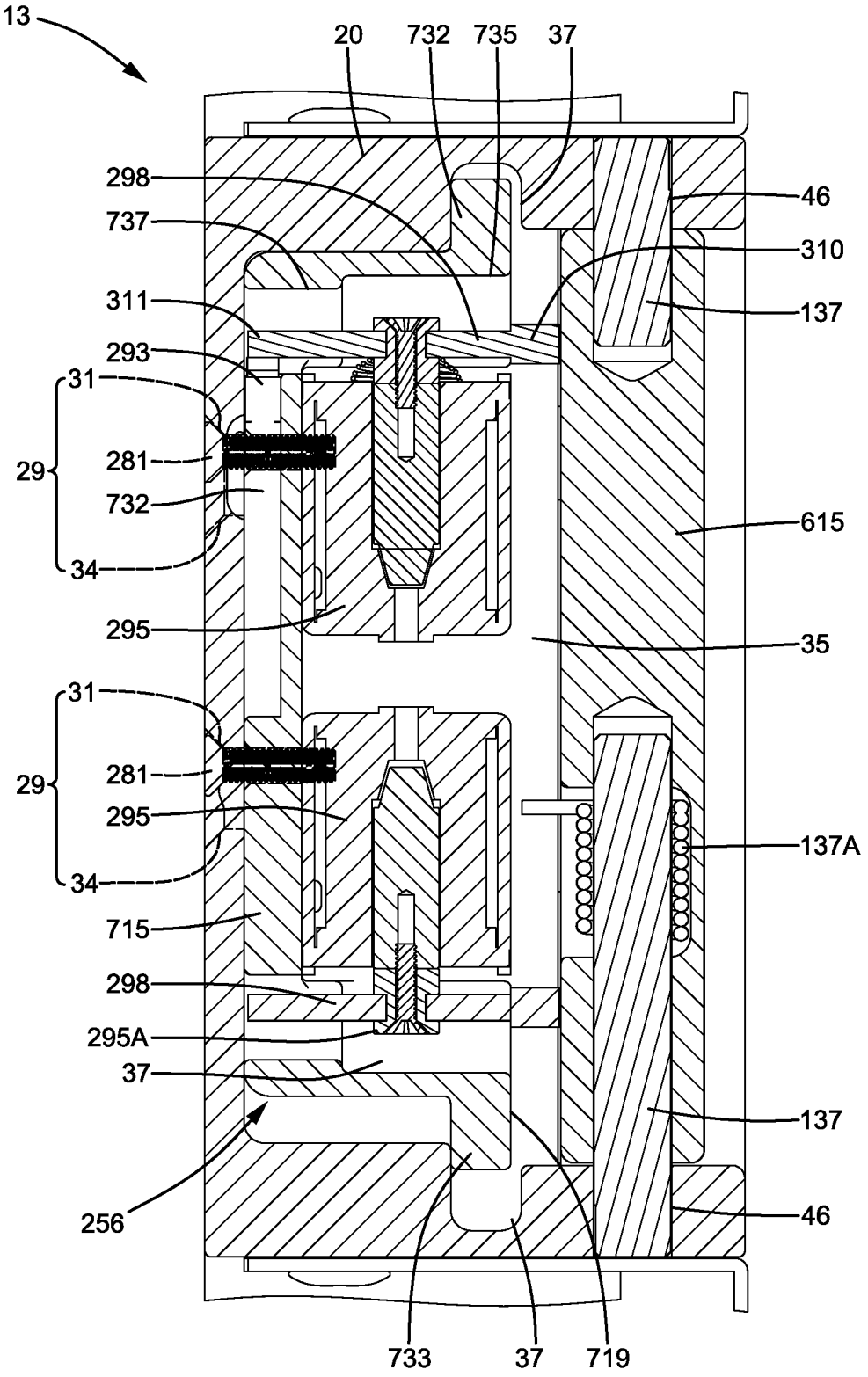
FIG. 11 is a view similar to FIG. 10 with a locking member of the electric locking device moved to a retracted position.

When the electric locking device 256 receives an unlocking signal, each of the two driving members 295 actuates a respective locking member 298 to move from the extended position (FIG. 10) to the retracted position (FIG. 11) (each stop portion 310 is in a non-blocking position not blocking the rotational movement of the associated first protrusion 637). In this state, each of the two locking members 298 moves to a position misaligned from the associated first protrusion 637 (each of the two locking members 298 is located below the associated first protrusion 637). Furthermore, the activation end 311 of one of the two locking members 298 presses against the status sensor 293 nearby (FIG. 11). Thus, the electric control device 13 is detected to be set in the unlocked state. In the unlocked state, the locking cap device 611 is not locked. Thus, when the door is pushed, the latch 151 of the cylindrical latch device 139 presses against the second lining member 655 of the locking cap device 611, pivoting the locking cap device 611 from the closure position (FIGS. 6 and 7) to the non-closure position (FIG. 12). Consequently, the latch 151 of the cylindrical latch device 139 can completely disengage from the electric control device 13.

After the latch 151 completely disengages from the electric control device 13, the return spring 137A returns the locking cap 613 to the closure position, and the bias spring 377 returns the actuation plate 679 to the contact position (FIGS. 12 and 13). The closure detection sensor 357 is pressed by the protrusion 699 of the actuation plate 679, such that each of the two driving members 295 moves a respective locking member 298 from the retracted position to the extended position. The two first protrusions 637 of the locking cap device 611 are stopped by the stop portions 310 of the two locking members 298 again, thereby locking the locking cap device 611.

When it is intended to close the door after the locking cap device 611 is locked while the latch 151 of the cylindrical latch device 139 is outside of the first compartment 28 of the mounting seat 20, the latch 151 of the cylindrical latch device 139 is pressed by the locking cap device 611 and retracts (not shown), such that cylindrical latch device 139 moves together with the door to a position aligned with the first outlet 238 of the first escutcheon 237. The latch 151 moves to the extended position and presses against the attachment member 711 to thereby actuate the actuation plate 679 to pivot from the contact position to the non-contact position again. Consequently, the latch 151 of the cylindrical latch device 139 is locked in the first compartment 28 of the mounting seat 20.

With reference to FIG. 7, it is noted that when the locking cap device 611 is in the closure position and each of the two locking members 298 is in the extended position, the stop portion 310 of each of the two locking members 298 abuts an associated first protrusion 637 (each stop portion 310 is in the blocking position blocking the rotational movement of the associated first protrusion 637), and the two protrusive ends 310A abuts the first face 719 of the bracket 715. In this state, when the door is directly pushed with an intention of destroying the door (trying to forcibly pivot the locking cap device toward the non-closure position), the locking cap 613 pivots to a position in which each of the two first protrusions 637 presses against an associated stop portion 310, such that each of the two locking members 298 withstands a lateral force perpendicular to the longitudinal axis of the pivot hole 46, such that the two protrusive ends 310A of each of the two locking members 298 are supported by the first face 719 of the bracket 715. The bracket 715 is supported by the inner face of the second compartment 35 and the two coupling grooves 37, such that each of the two locking members 298 is less likely to deform and damage due to pressing. Furthermore, when each of the two locking members 298 is pressed, since the bracket 715 provides support, the shafts 295A of the driving members 295 are less likely to damage by an excessively large shear force, reducing the possibility of damage to the shafts 295A.

Figure 15:
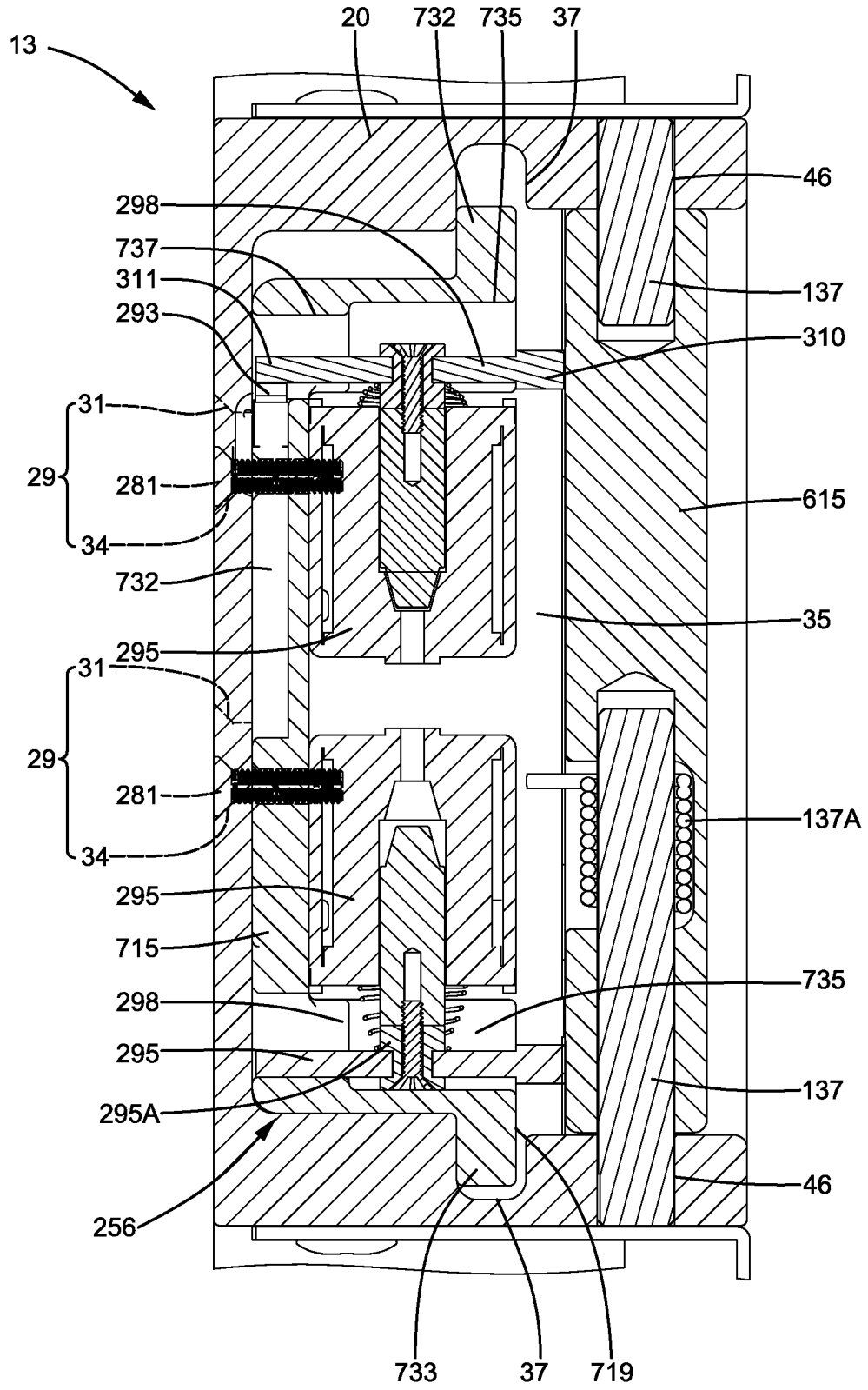
FIG. 15 is a cross sectional view of the electric control device installed in the second position and with the locking member in a retracted position.

Furthermore, in addition to setting the electric locking device 256 installed in the first position as a normally closed state, the electric locking device 256 installed in the second position can be set as a normally open state. With reference to FIGS. 14 and 14A, in a case that the electric locking device 256 is installed in the second position, when the locking cap device 611 is in the closure position and each of the two locking members 298 is in the extended position, one of the two locking members 298 is located between the first and second protrusions 637 and 639 along the longitudinal axis of the pivot hole 46, and the other locking member 298 is misaligned from the two first protrusions 637 along the longitudinal axis of the pivot hole 46, such that the rotational path of the first and second protrusions 637 and 639 are not impeded by the two locking members 298, and the locking cap device 611 is not locked. As a result, the latch 151 of the cylindrical latch device 139 is pivotable together with the door to pivot the locking cap device 611 from the closure position to the non-closure position. With reference to FIG. 15, when each of the two driving members 295 actuates the respective locking member 298 to the retracted position and the locking cap device 611 is in the closure position, the one of the two locking members 298 abuts an associated second protrusion 639, and the other locking member 298 abuts an associated first protrusion 637. Thus, the locking cap device 611 is locked.

Thus, by changing the installation position of the electric locking device 256 in the first position or the second position, the electric control device 13 can be set in a normally open state or a normally closed state.

Note that when the locking cap device 611 is in the closure position, the two high temperature locking devices 551 are aligned with the two pin holes 33 of the mounting seat 20 (FIG. 9). In a case that a fire occurs and, thus, generates high heat, the lower melting point members 573 made of plastic material melt, and each ejection springs 591 pushes the associated pin 575 to engage the coupling end 579 of the associated pin 575 with an associated pin hole 33 (see FIG. 16). In this state, even though each of the two locking members 298 is moved to a position misaligned from the first and second protrusions 637 and 639, the locking cap device 611 cannot move from the closure position to the non-closure position. Thus, the latch 151 of the cylindrical latch device 139 is retained in the first compartment 28. As a result, the door cannot be opened.

Figure 18:
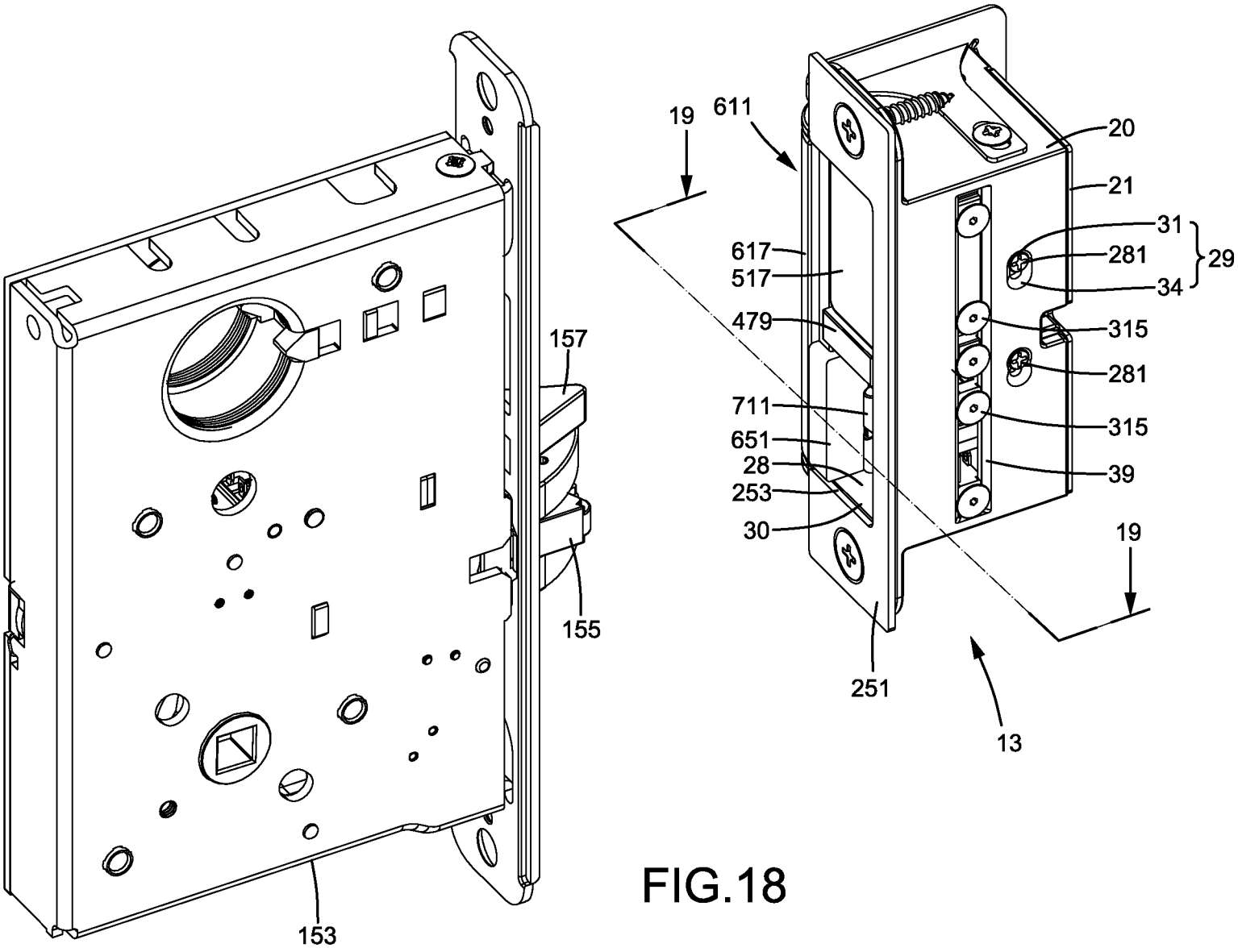
FIG. 18 is a perspective view of the electric control device assembled into a second mode.
Figure 19:
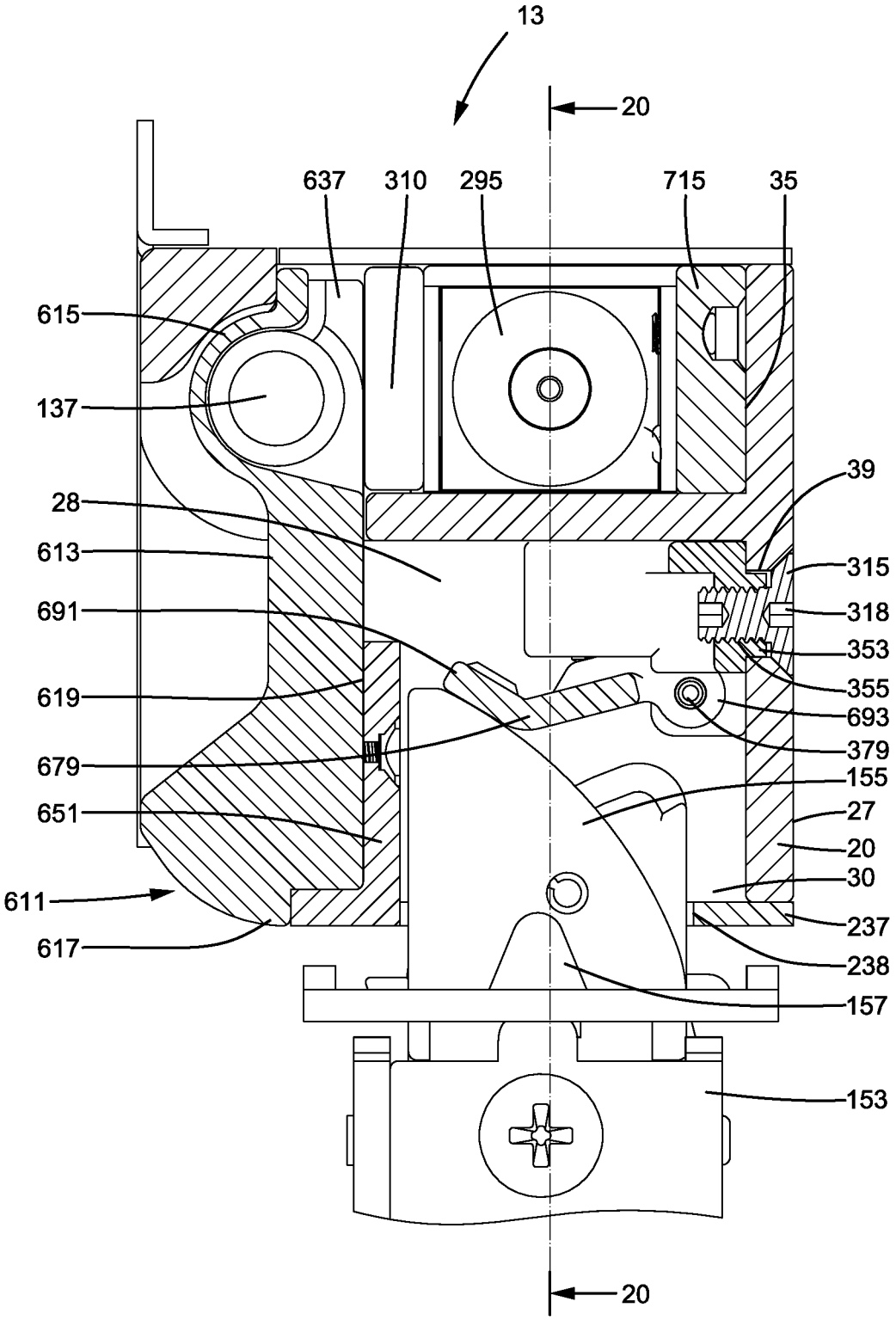
FIG. 19 is a cross sectional view taken along section line 19-19 of FIG. 18.
Figure 20:
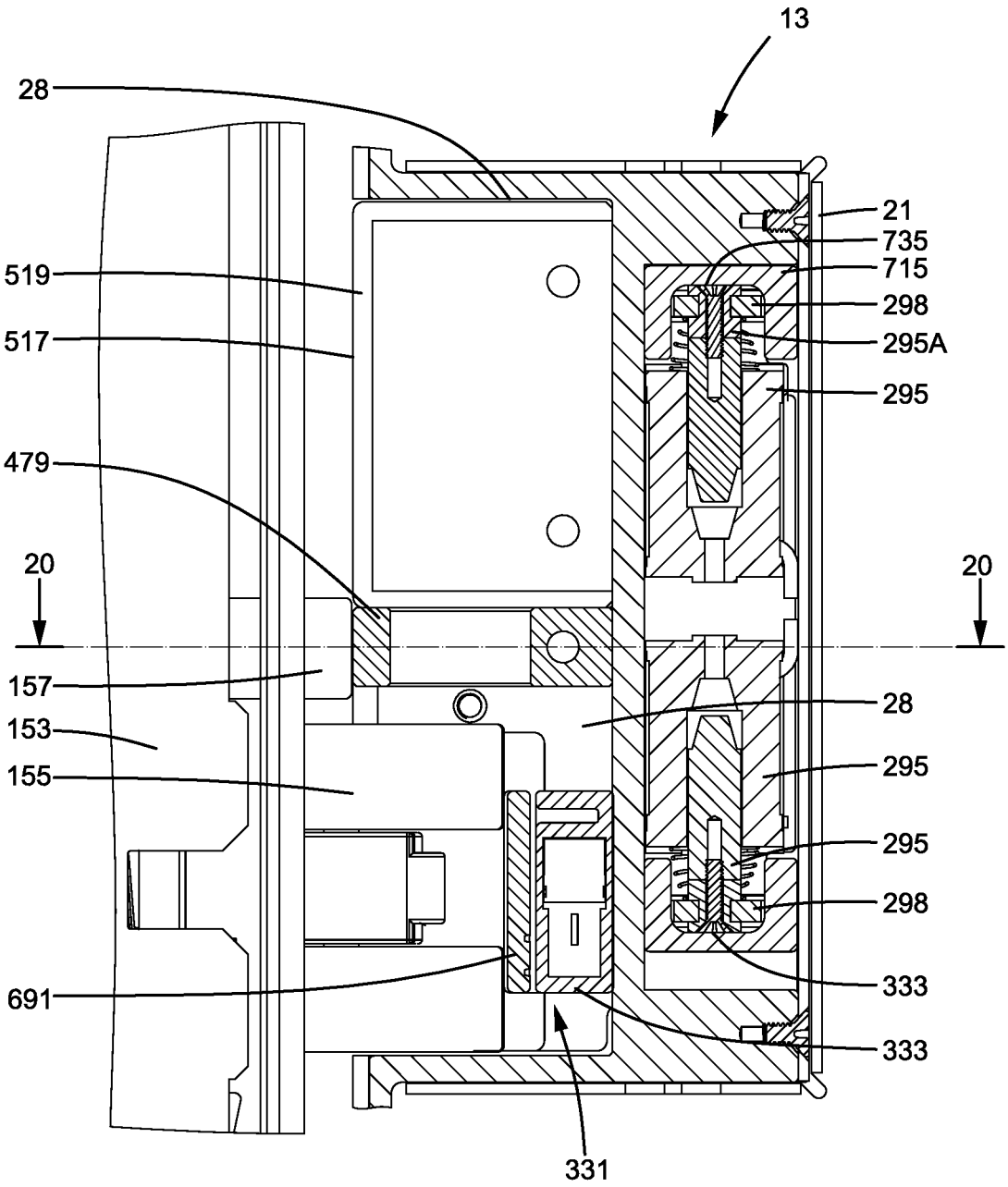
FIG. 20 is a cross sectional view taken along section line 20-20 of FIG. 19.

In addition to assembling the electric control device 13 into the first mode cooperating with the cylindrical latch device 139, the electric control device 13 can be assembled into a second mode for cooperating with a first box type latch device 153. With reference to FIGS. 18-20, the first box type latch device 153 is mounted inside a door and includes a first latch 155 and a first anti-pick latch 157. The first latch 155 and the first anti-pick latch 157 are exposed outside of an end face of the door.

Since the first latch 155 of the first box type latch device 153 is at a lower side of the first compartment 28, each of the two locking members 298 must be spaced from the first and second protrusions 637 and 639. Then, the locking cap device 611 is manually pivoted from the closure position to the non-closure position. Thus, two second driving holes 319 of two fixing screws 315 attached to the detecting device 331 will be exposed, and a hand tool 593 (such as a hexagonal wrench or a screwdriver) can be used to couple with each second driving hole 319 to loosen the associated fixing screws 315 (see FIG. 17). Next, the detection device 331 is moved along the track 39 to a position near the lower end of the first compartment 28 (which is substantially aligned with the first latch 155, see FIG. 20) and is then fixed by again using the hand tool 593 to fix these two fixing screws 315.

Since the first latch 155 of the first box type latch device 153 is larger in size, the second lining member 655 is detached, and the first lining member 651 is still used (see FIG. 19). Furthermore, since the first latch 155 of the first box type latch device 153 must be in a lower position relative to the electric control device 13, the first lining member 651 must be moved to a position corresponding to the first latch 155. Next, the two threaded fasteners 658 extend into the associated positioning screw holes 631 to position the first lining member 651. Note that the first escutcheon 237 is detached, and the second escutcheon 251 is mounted to the front face 22 of the mounting seat 20 to match with the position of the first latch 155 of the first box type latch device 153. Furthermore, the attachment member 711 of the detecting device 331 is also detached in response to the size of the first latch 155.

Furthermore, when it is desired to assemble the electric control device 13 into the second mode, the third accessory 517 and the first accessory 479 corresponding to the first anti-pick latch 157 are installed in the first compartment 28 of the mounting seat 20. Since the first box type latch device 153 does not include a locking latch, the empty space in the first compartment 28 must be filled. In an approach, the third accessory 517 is disposed in a position near the upper end of the first compartment 28 to conform to the position of the first box type latch device 153, and the third sliding block 531 is slidably received in the guiding plate 433. To fix the third accessory 517 in the first compartment 28, two fixing screws 315 are used to couple with the two third threaded holes 533 via the track 39 from outside of the mounting seat 20. These two fixing screws 315 are tightened to tightly press the third accessory 517 against the inner surface of the first chamber 28 for positioning purposes.

Note that in a case that the first accessory 479 or the third accessory 517 is in an incorrect position, when the locking cap device 611 is in the non-closure position, the hand tool 593 is used to extend through the first through-hole 495 of the first accessory 479 or the third through-hole 535 of the third accessory 517 to couple with the second driving hole 319 of an associated fixing screw 315. By loosening (not detaching) these two fixing screws 315, the position of the first accessory 479 or the third accessory 517 can be adjusted along the track 39. After the first accessory 479 or the third accessory 517 reaches the correct position, these two fixing screws 315 are tightened to fix the position of the first accessory 479 and the third accessory 517.

The first accessory 479 is received in the first compartment 28 and is aligned with the first anti-pick latch 157 of the first box type latch device 153 (i.e., between the detecting device 331 and the third accessory 517, see FIG. 20). The first sliding block 491 of the first accessory 479 is received in the track 39. One of the fixing screws 315 extends from outside of the mounting seat 20 through the track 39 to threadedly couple with the first threaded hole 493. When this fixing screw 315 is tightened, the first accessory 479 tightly presses against the inner surface of the first compartment 28 and is, thus, fixed. As a result, the first accessory 479 is fixed in a position aligned with the first anti-pick latch 157.

With reference to FIG. 20, when the first latch 155 is in the first compartment 28, the actuation plate 679 of the detecting device 331 is pressed by the first latch 155 to the non-contact position. The first anti-pick latch 157 is pressed by the first accessory 479 and retracts. With the first anti-pick latch 157 in the retracted state, the first latch 155 cannot be pressed and retracted. Thus, the first latch 155 provides an anti-pick effect. The space in the first compartment 28 not cooperating with the first box type latch device 153 is filled by the third accessory 517.

Similarly, when the door is pushed while the locking cap device 611 is in the unlocked state, the first latch 155 of the first box type latch device 153 presses against the first lining member 651 to pivot the locking cap device 611 from the closure position to the non-closure position. On the other hand, when the locking cap device 611 is in the locked state, the first latch 155 of the first box type latch device 153 is restrained in the first compartment 28 of the mounting seat 20.

Figure 21:
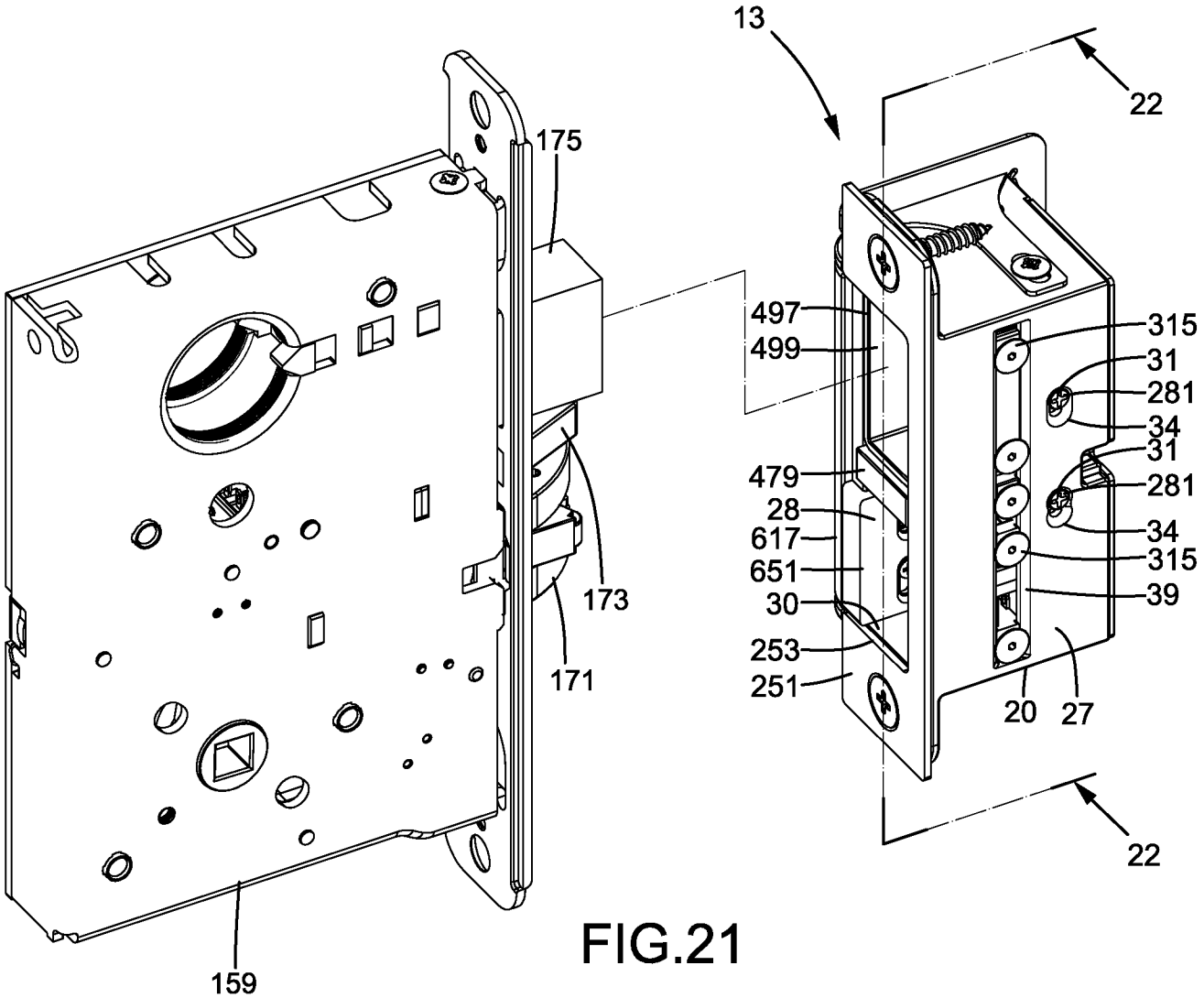
FIG. 21 is a perspective view of the electric control device assembled into a third mode.
Figure 22:
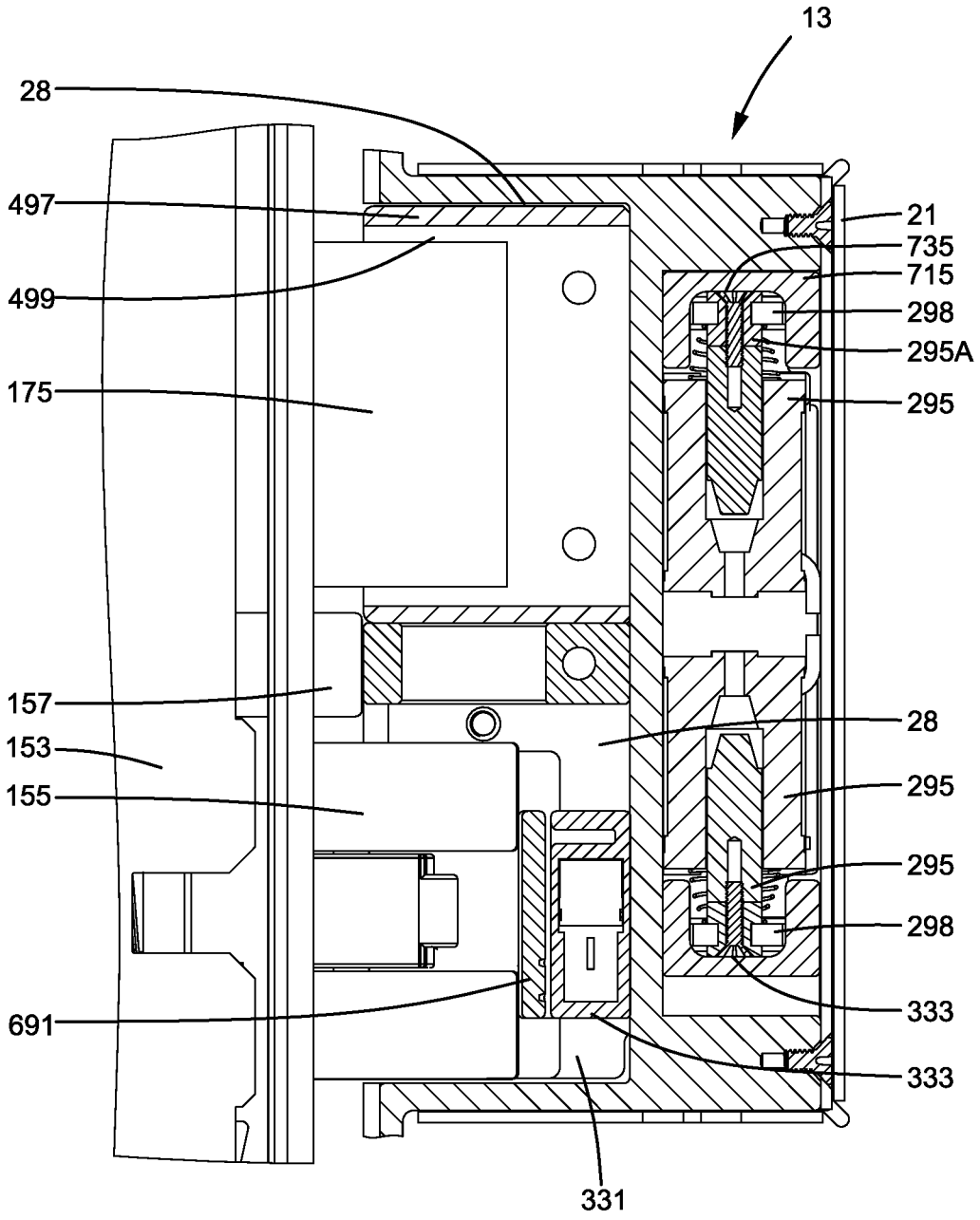
FIG. 22 is a cross sectional view taken along section line 22-22 of FIG. 21.

With reference to FIGS. 21 and 22, the electric control device 13 can be assembled into a third mode for cooperating with a second box type latch device 159. The second box type latch device 159 includes a second latch 171, a second anti-pick latch 173, and a locking latch 175 movable between an extended position and a retracted position. The second anti-pick latch 173 is located between the locking latch 175 and the second latch 171.

When the electric control device 13 is assembled into the third mode to cooperate with the second box type latch device 159, the first accessory 479 and the second accessory 497 are installed in the first compartment 28 of the mounting seat 20. In a case of the second accessory 497, two fixing screws 315 are used to extend from outside of the mounting seat 20 through the track 39 to threadedly couple with the two second screw holes 513. Then, the two fixing screws 315 are tightened to press the second accessory 497 against the inner surface of the mounting seat 20 for positioning purposes. Thus, the second accessory 497 is fixed in the first compartment 28 and near the upper end of the first compartment 28. Similarly, the first accessory 479 is fixed between the second accessory 497 and the detecting device 331. The second escutcheon 251 is installed on the front face 22 of the mounting seat 20. Thus, the second accessory 497 is aligned with the locking latch 175, the second anti-pick latch 173 is aligned with the first accessory 479, and the second latch 171 is aligned with the detecting device 331.

When the door is closed, the locking latch 175 is received in the locking latch hole 499 of the second accessory 497, the second anti-pick latch 173 is pressed by the first accessory 479 and retracts, and the second latch 171 is received in the first compartment 28.

Since the second accessory 497 is fixed in the first compartment 28, when the locking latch 175 is located in the locking latch hole 499 of the second accessory 497 (see FIG.

22), the locking latch 175 cannot pivot together with the door to disengage from the second accessory 497, such that even if the locking cap device 611 is set to the unlocking state, the second latch 171 cannot move the locking cap device 611 from the closure position to the non-closure position, thereby providing a locking function.

When the locking latch 175 of the second box type latch device 159 retracts and disengages from the locking latch hole 499 of the second accessory 497, if the locking cap device 611 is set in the locking state, the second latch 171 still cannot pivot the locking cap device 611 to the non-closure position outside of the first compartment 28, thereby providing a locking function.

When the locking latch 175 of the second box type latch device 159 retracts and disengages from the locking latch hole 499 of the second accessory 497, if the locking cap device 611 is set in the unlocked state, the second latch 171 can pivot the locking cap device 611 to the non-closure position outside of the first compartment 28, thereby providing an unlocking function.

In the electric control device 13 according to the present invention, the bracket 715 of the electric locking device 256 is assembled to directly abut the inner face of the second compartment 35 of the mounting seat 20, and each of the two locking members 298 abuts the bracket 715. When each of the two locking members 298 is located on the rotational path of the first or second protrusion 637, 639, the two locking members 298 are less likely to deform due to pressing by the first or second protrusion 637, 639, reducing the possibility of damage to the two locking members 298.

Since each of the two locking members 298 abuts the bracket 715 when subjected to force, the shaft 295A of each of the two driving members 295 subjected to force are less likely to damage.

The electric control device 13 can be used to electrically control opening of the door without replacing the original cylindrical latch device 139 or the original box type latch device 153, 159 by assembling the electric control device 13 into the first, second, or third mode, which can be achieved rapidly.

With the locking cap device 611 of the electric control device 13 in the non-closure position, by using the fixing screws 315 having the second driving holes 319, the fixing screws 315 can be fixed by engaging a hand tool 593 with the second driving hole 319 of each fixing screw 315. Thus, the positions of the detecting device 311, the first accessory 479, the second accessory 497, and the third accessory 517 can be rapidly adjusted without detaching the electric control device 13 from the door, and the positions of the detecting device 311, the first accessory 479, the second accessory 497, and the third accessory 517 can be fixed in place after tightening the screw holes 315, providing excellent adjusting convenience during installation.

After moving the locking cap device 611 to the non-closure position, the electric control device 13 can be rapidly assembled to conform to the associated latch device by selective assembly, detachment, or adjustment of the position of the first accessory 479, the second accessory 497, and the third accessory 517.

The electric locking device 256 can be installed in the first position or the second position to rapidly set the electric control device 13 in a normally open state or a normally closed state.

As long as the two locking members 298 are in a position spaced from the first and second protrusions 637 and 639, the locking cap device 611 can be manually moved to the non-closure position, such that the second driving hole 319 of each fixing screw 315 threadedly engaged with the first accessory 479, the second accessory 497, the third accessory 517, and the detecting device 331, can be exposed to permit easy coupling with the hand tool 593 for loosening each fixing screw 315, which allows minor adjustment of the first accessory 479, the second accessory 497, the third accessory 517, and the detecting device 331 to thereby cooperate with the corresponding cylindrical latch device 139, the first box type latch device 153, and the second box type latch device 159. Namely, the minor adjustment can be easily achieved.

When the two lower melting point members 573 melt due to a fire, the pins 575 couple with the pin holes 33 of the mounting seat 20. Even if the two locking members 298 move to a position spaced from the first and second coupling portions 419 and 431 and the locking latch 175 of the second box type latch device 159 disengages from the locking latch hole 499 of the second accessory 497, the locking cap device 611 cannot pivot from the closure position to the non-closure position. Thus assures the door will not open in any unexpected condition during the fire, reducing the spreading speed of the fire.

Now that the basic teachings of the present invention have been explained, many extensions and variations will be obvious to one having ordinary skill in the art. For example, the electric control device 13 can cooperate with a latch device other than the cylindrical latch device 139, the first box type latch device 153, and the second box type latch device 159. When the electric control device 13 is assembled into the second mode, a first box type latch device 153 (whose first latch 155 and first anti-pick latch 157 are arranged in different locations) can be used by adjusting the positions of the first accessory 479, the third accessory 517, and the detecting device 331 in the first compartment 28. Furthermore, when the electric control device 13 is assembled into the third mode, a second box type latch device 159 (whose second latch 171 and second anti-pick latch 159 are arranged in different locations) can be used by adjusting the positions of the second accessory 497, the third accessory 517, and the detecting device 331 in the first compartment 28.

Furthermore, the electric control device 13 can include only one high temperature locking device 551, only one driving member 295, and only one locking member 298. The number of the corresponding components can be reduced accordingly.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An electric control device for a latch, the electric control device comprising:

a mounting seat including a first compartment and a second compartment, wherein the first compartment is configured to receive the latch;

an electric locking device including a bracket securely mounted in the second compartment and a driving member securely mounted to the bracket, wherein the bracket includes a first face, wherein the driving member is coupled with a locking member including a stop portion having a protrusive end, wherein the protrusive end abuts the first face of the bracket, and wherein the driving member is configured to actuate the locking member; and a locking cap device pivotably connected to the mounting seat and received in the first compartment, wherein the locking cap device includes an inner side having a first protrusion corresponding to the stop portion, wherein the driving member is configured to actuate the locking member to move the stop portion of the locking member between a blocking position blocking rotational movement of the first protrusion of the locking cap device and a non-blocking position not blocking the rotational movement of the first protrusion of the locking cap device, wherein when the stop portion is in the blocking position blocking the rotational movement of the first protrusion, the locking cap device is not pivotable from a closure position to a non-closure position, such that the latch is blocked by the locking cap device and is prevented from moving out of the first compartment, wherein when the stop portion is in the non-blocking position not blocking the rotational movement of the first protrusion, the locking cap device is pivotable relative to the mounting seat between the closure position and the non-closure position, such that the latch is jointly movable with the locking cap device and is movable out of the first compartment, and wherein when the stop portion is in the blocking position and the locking cap device is subjected to a force to pivot toward the non-closure position, the first protrusion of the locking cap device presses against the stop portion of the locking member, and the protrusive end of the locking member is supported by the first face of the bracket, reducing a shear force imparted to the driving member via the locking member.

2. The electric control device for the latch as claimed in claim 1, wherein the bracket includes a second face spaced from the first face, wherein the second face abuts an inner face of the second compartment, and wherein when the stop portion is in the blocking position and the locking cap device is subjected to the force to pivot toward the non-closure position, the protrusive end of the locking member is supported by the first face of the bracket, and the bracket is supported by the inner face of the second compartment of the mounting seat, reducing the shear force imparted to the driving member via the locking member.

3. The electric control device for the latch as claimed in claim 2, wherein the inner face of the second compartment includes two coupling grooves, wherein the bracket includes two outer ends, wherein each of the two outer ends of the bracket includes a protrusion coupled with an associated one of the two coupling grooves, and wherein when the stop portion is in the blocking position and the locking cap device is subjected to the force to pivot toward the non-closure position, the protrusive end of the locking member is supported by the first face of the bracket, and the bracket is supported by the two coupling grooves, reducing the shear force imparted to the driving member via the locking member.

4. The electric control device for the latch as claimed in claim 1, wherein the electric locking device further includes a status sensor, wherein the bracket further includes a groove adjacent to the outer end and a recessed portion corresponding to the groove, wherein the groove extends to the first face, wherein the locking member is movably received in the groove, wherein the stop portion of the locking member is located outside of the groove, wherein the status sensor is received in the recessed portion without extending beyond the second face, wherein the locking member includes an activation end interlocked with the status sensor, and wherein when the locking member moves from an extended position to a retracted position, the activation end activates the status sensor.

5. The electric control device for the latch as claimed in claim 1, further comprising a detecting device movably received in the first compartment, wherein the detecting device includes:

a supporting seat including a first side and a second side, wherein the supporting seat further includes a recess between the first side and the second side and an assembling hole extending from the first side to the recess, wherein the supporting seat further includes a receiving hole extending from the second side to the recess;

a closure detection sensor received in the recess;

a fastener including an enlarged portion and an extension arm extending from the enlarged portion, wherein the extension arm includes a deformable end at a distal end thereof, wherein the deformable end includes a slit in a central portion thereof and two tabs on two sides of the slit, wherein the enlarged portion of the fastener is received in the receiving hole, wherein the extension arm extends through the closure detection sensor, and wherein the deformable end is detachably coupled with the assembling hole; and an actuation plate pivotably connected to the supporting seat, wherein the actuating plate is pivotable between a non-contact position not activating the closure detection sensor and a contact position activating the closure detection sensor.

6. The latch control device as claimed in claim 1, wherein the locking cap device includes:

a locking cap pivotably connected to the mounting seat and received in the first compartment, wherein the locking cap includes an inner face having a plurality of positioning screw holes spaced from each other along a pivot axis of the locking cap;

a first lining member including a first slot extending along the pivot axis of the locking cap, wherein the first lining member abuts the inner face of the locking cap; and a threaded fastener extending through the first slot and in threading connection with one of the plurality of positioning screw holes, wherein the threaded fastener is tightened, the first lining member is not movable relative to the locking cap, and wherein when the threaded fastener is loosened, the first lining member is movable in an extent of the first slot relative to the locking cap.

7. The latch control device as claimed in claim 1, wherein the protrusive end is parallel to the first face of the bracket.

* * * * *